US011079182B2

(12) United States Patent
Kawaguchi et al.

(10) Patent No.: US 11,079,182 B2
(45) Date of Patent: Aug. 3, 2021

(54) HEAT EXCHANGER

(71) Applicant: NGK INSULATORS, LTD., Nagoya (JP)

(72) Inventors: Tatsuo Kawaguchi, Nagoya (JP); Takeshi Sakuma, Nagoya (JP); Daisuke Kimura, Nagoya (JP); Hiroshi Mizuno, Nagoya (JP); Makoto Yoshihara, Nagoya (JP); Takafumi Hamada, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 84 days.

(21) Appl. No.: 16/354,707

(22) Filed: Mar. 15, 2019

(65) Prior Publication Data

US 2019/0301807 A1 Oct. 3, 2019

(30) Foreign Application Priority Data

Mar. 30, 2018 (JP) ..... JP2018-069609
Dec. 20, 2018 (JP) ..... JP2018-238821

(51) Int. Cl.
*F28D 7/00* (2006.01)
*F28F 7/02* (2006.01)
*F28F 13/12* (2006.01)

(52) U.S. Cl.
CPC ..... *F28D 7/0025* (2013.01); *F28F 7/02* (2013.01); *F28F 13/12* (2013.01)

(58) Field of Classification Search
CPC .... F28D 2021/008; F28D 7/0025; F28D 7/10; F28F 13/12; F28F 7/02; F28F 9/0219; F28F 9/0246
See application file for complete search history.

(56) References Cited

U.S. PATENT DOCUMENTS 9,624,814 B2 * 4/2017 Mitsuda ..... B60K 11/04
2009/0136710 A1 * 5/2009 Ichikawa ..... C04B 35/195 428/117
2012/0222838 A1 * 9/2012 Hisanaga ..... F01N 13/082 165/96
2012/0247732 A1 * 10/2012 Suzuki ..... F28F 21/04 165/104.14

(Continued)

FOREIGN PATENT DOCUMENTS

JP 2012-037165 A1 2/2012

*Primary Examiner* — Henry T Crenshaw
(74) *Attorney, Agent, or Firm* — Burr & Brown, PLLC

(57) ABSTRACT

A heat exchanger according to the present invention includes: a pillar shaped honeycomb structure having a plurality of cells, the cells providing first flow paths through which a first fluid is passed; an inner cylinder attached to an outer periphery of the honeycomb structure; and an outer cylinder disposed on an outer periphery of the inner cylinder, the outer cylinder providing a second flow path through which a second fluid is passed, the second flow path being arranged between the outer cylinder and the inner cylinder. The second flow path includes: an intermediate flow path extending in an axial direction of the honeycomb structure so as to include an outer peripheral position of the honeycomb structure; and side flow paths located on both sides of the intermediate flow path in the axial direction. The intermediate flow path has a height lower than that of each of the side flow paths.

18 Claims, 20 Drawing Sheets

(56) References Cited

U.S. PATENT DOCUMENTS

| | | | | |
|---|---|---|---|---|
| 2014/0326438 | A1* | 11/2014 | Seryi | F28D 7/106<br>165/154 |
| 2015/0292812 | A1* | 10/2015 | Tomita | F28F 13/12<br>165/177 |
| 2016/0341489 | A1* | 11/2016 | Ichiyanagi | F28D 7/005 |

* cited by examiner

[FIG. 1]
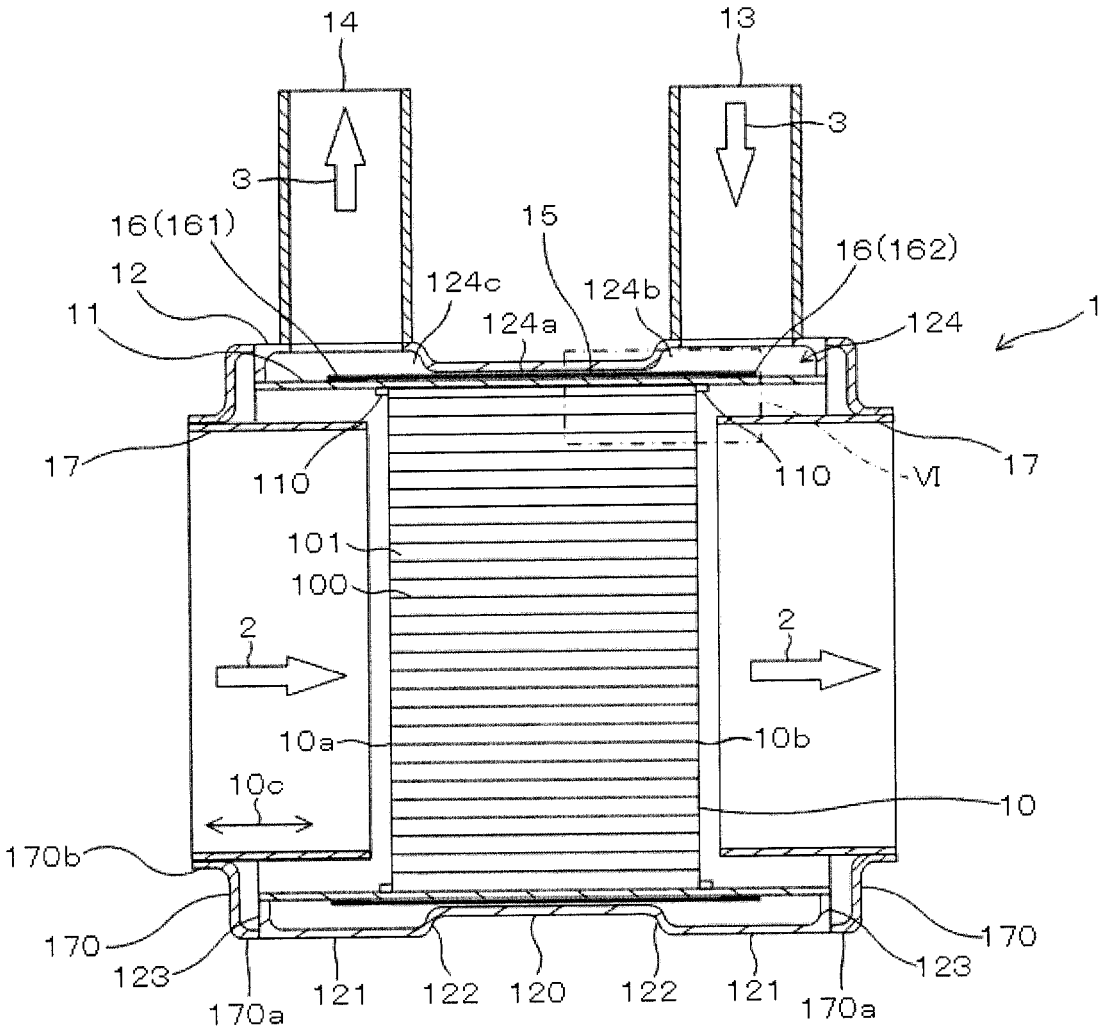

[FIG. 2]
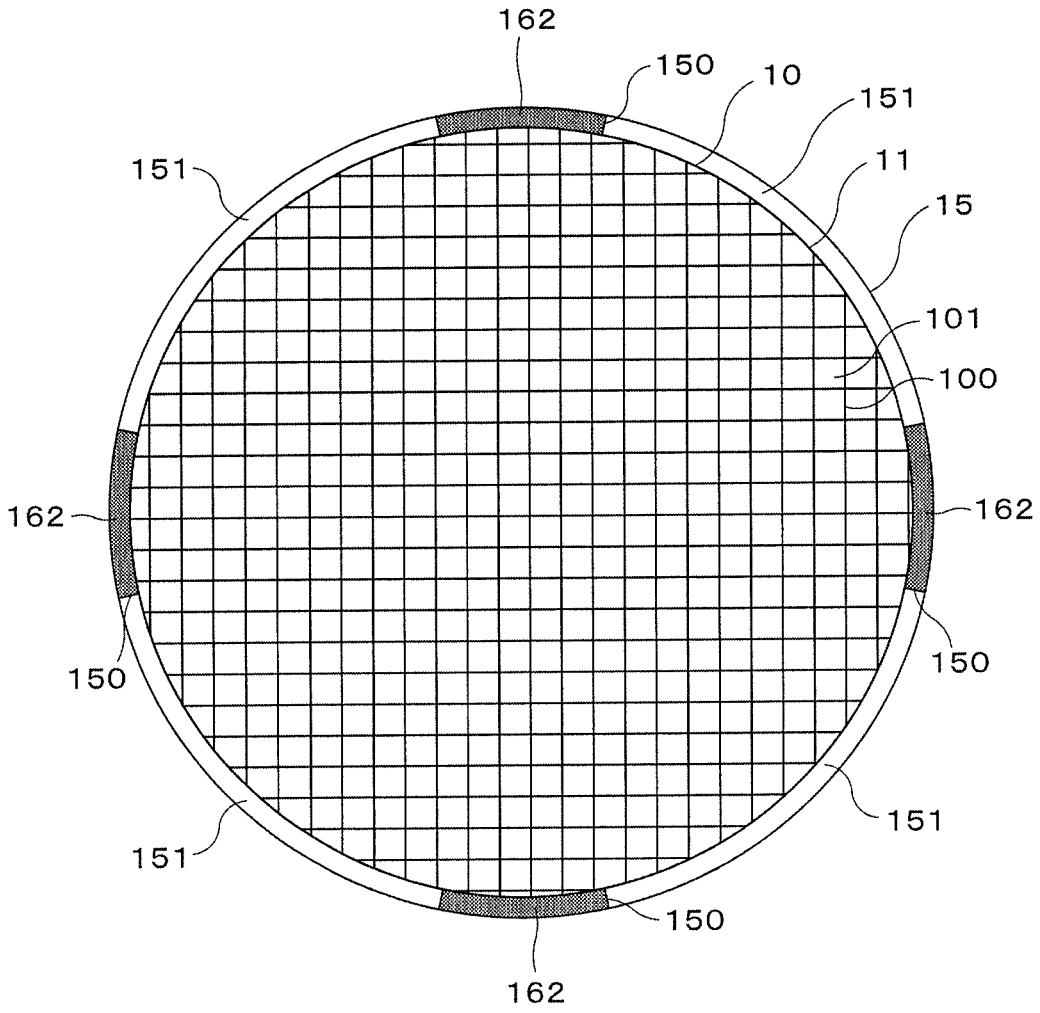

[FIG. 3]
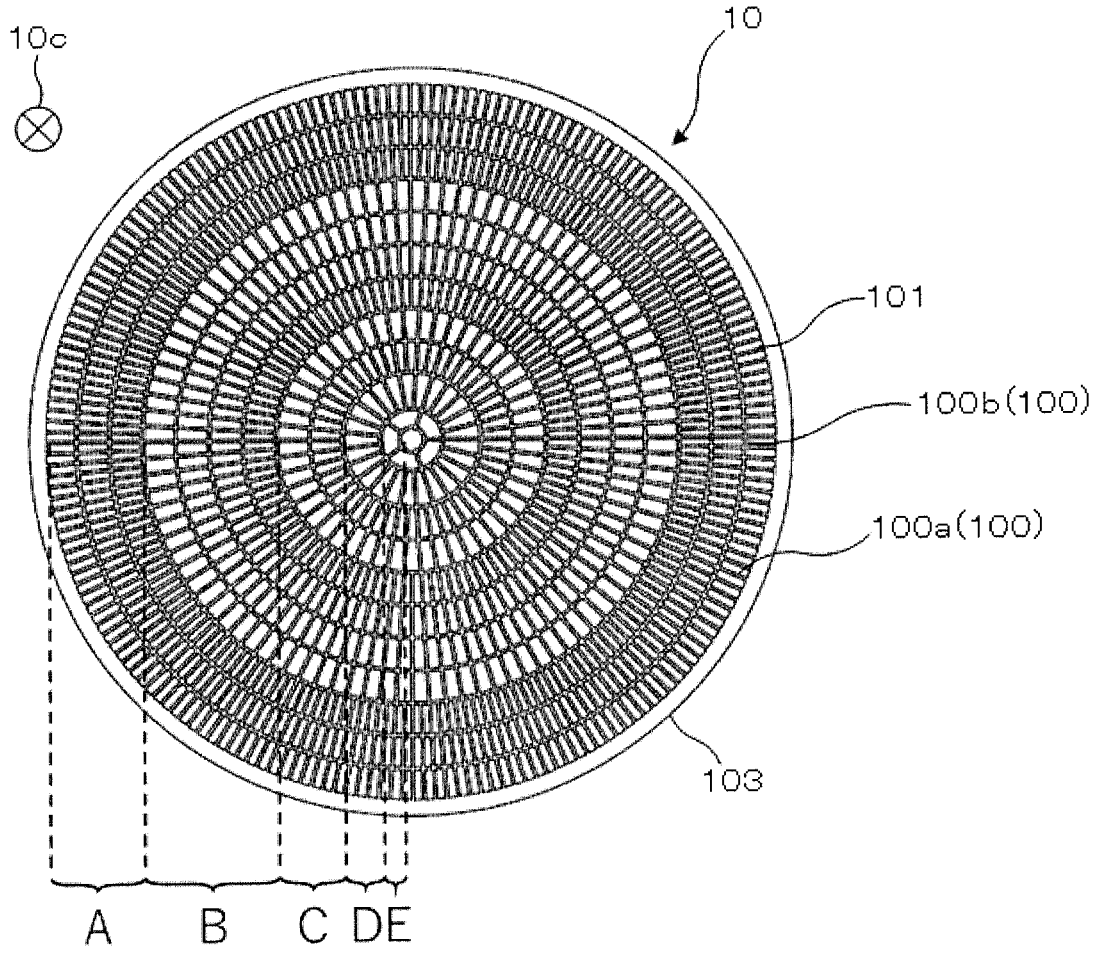

[FIG. 4]
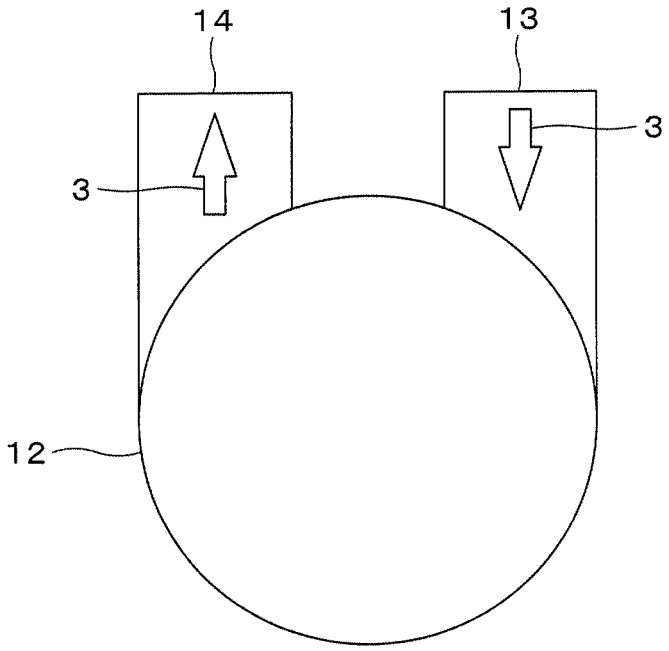

[FIG. 5]
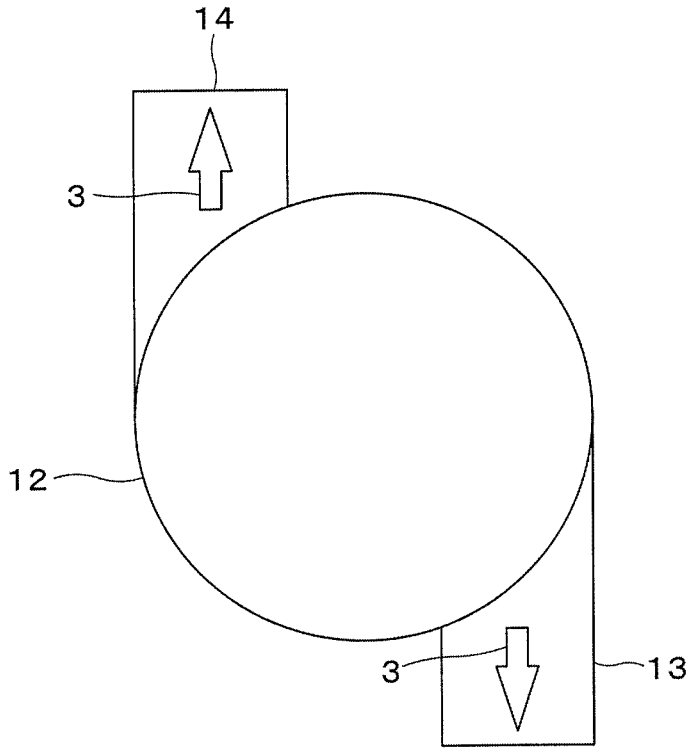

[FIG. 6]
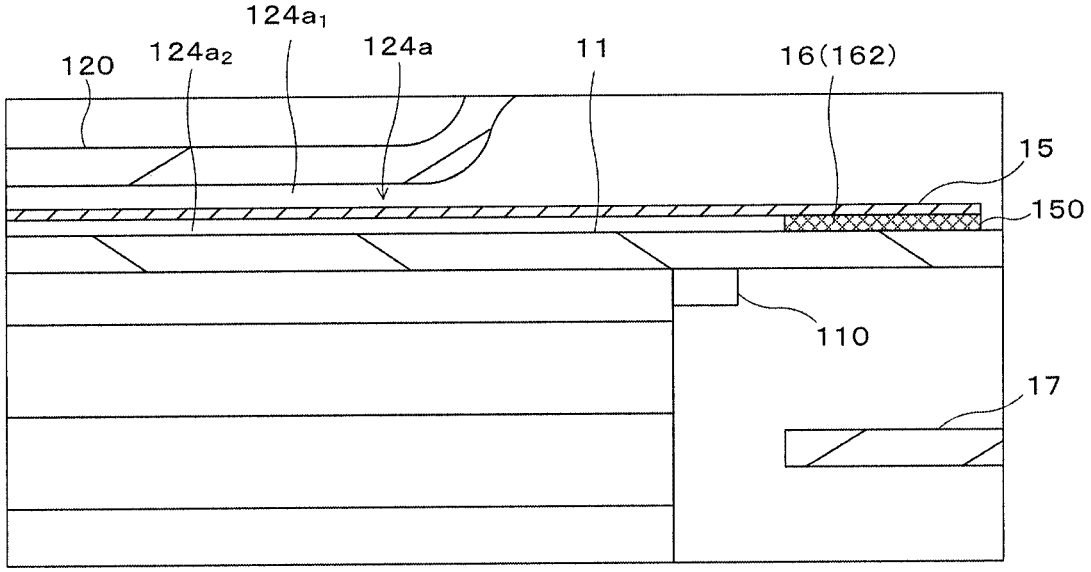

[FIG. 7]
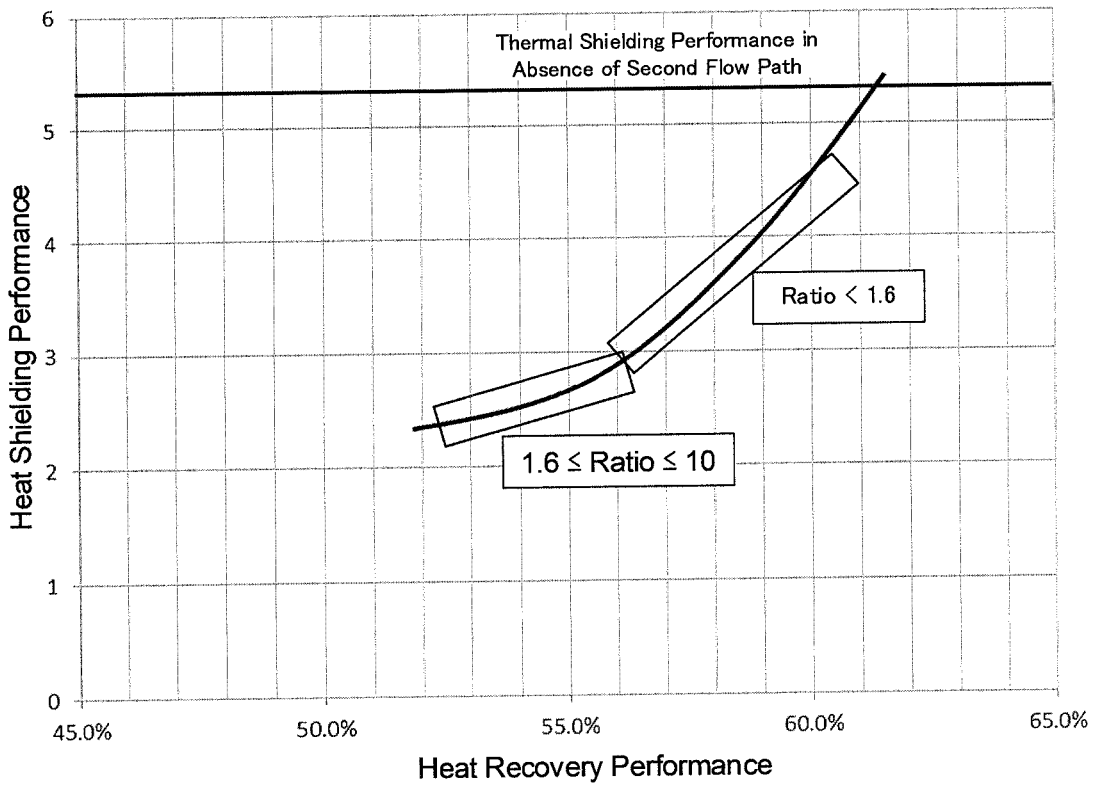

[FIG. 8]
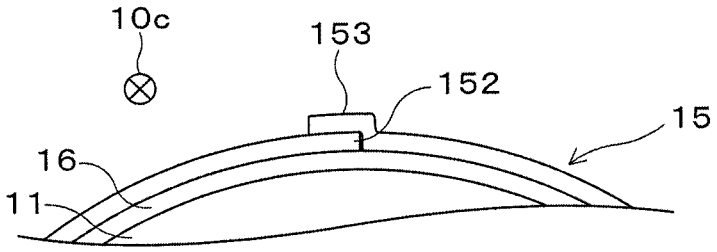

[FIG. 9]
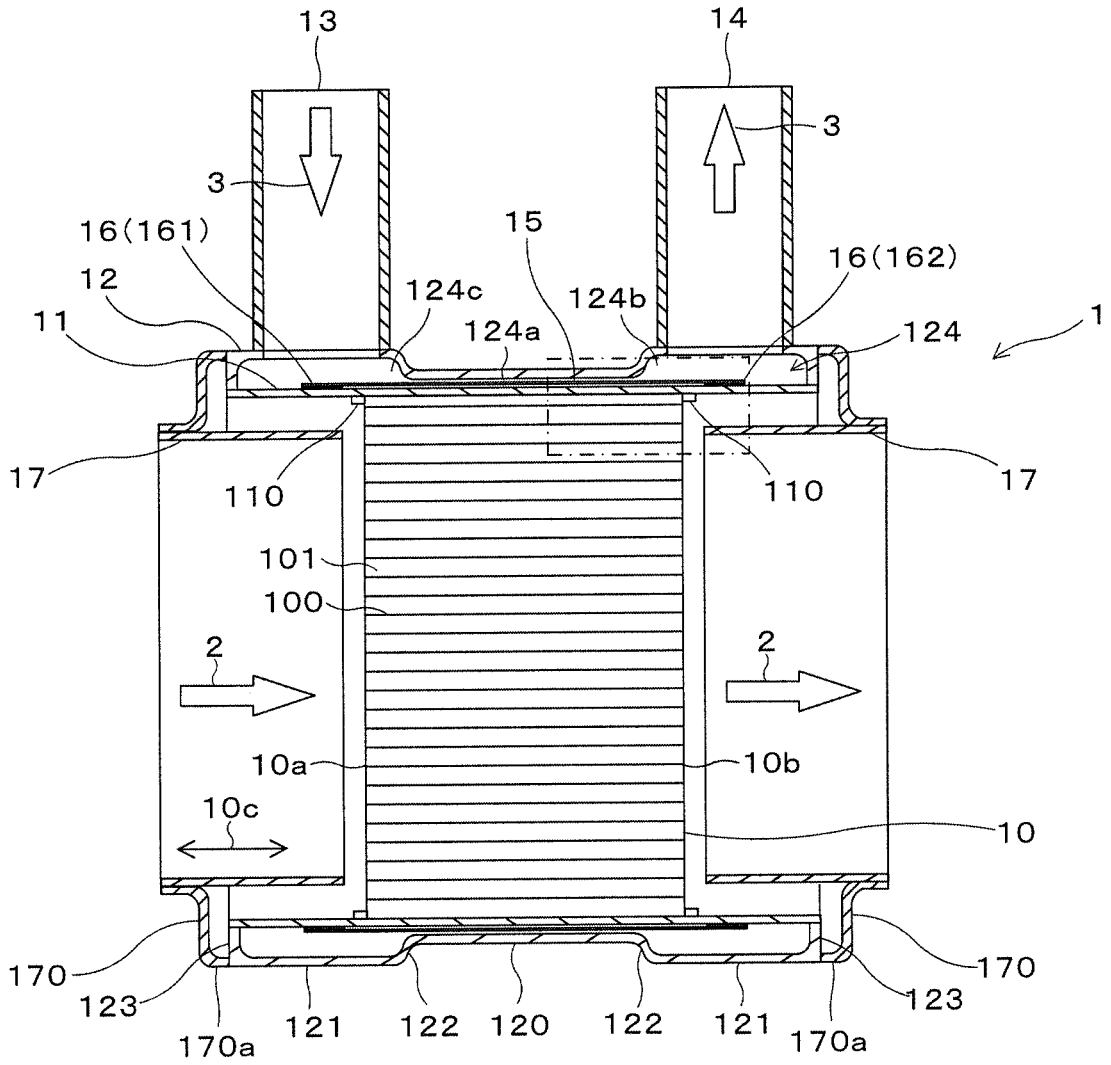

[FIG. 10]
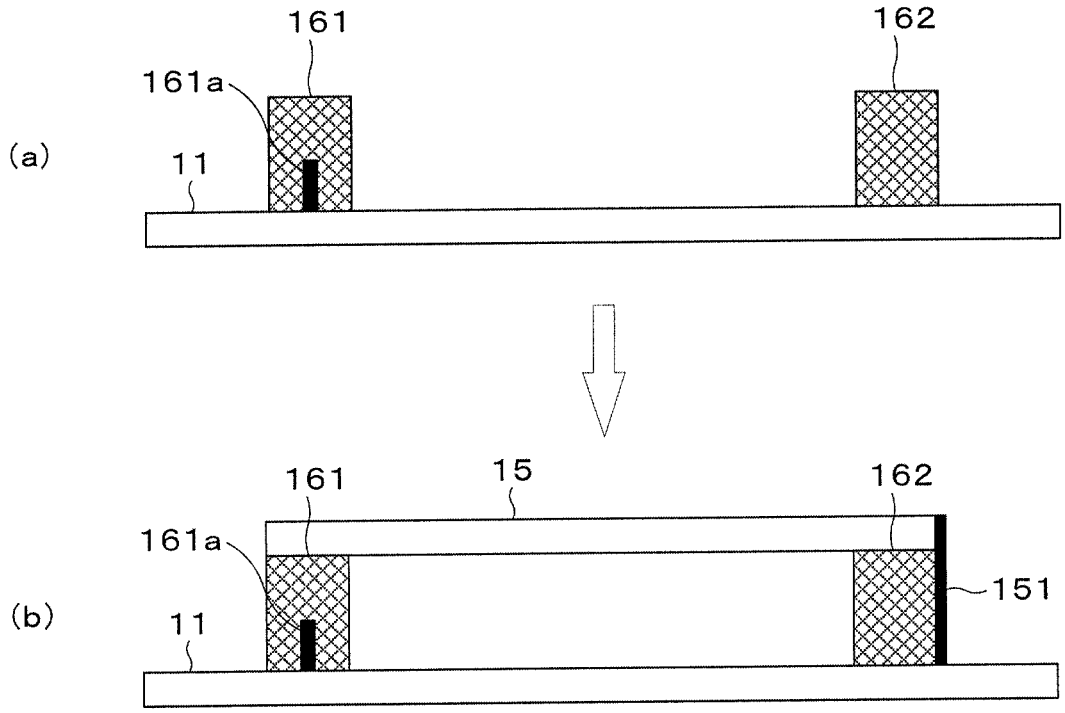

[FIG. 11]
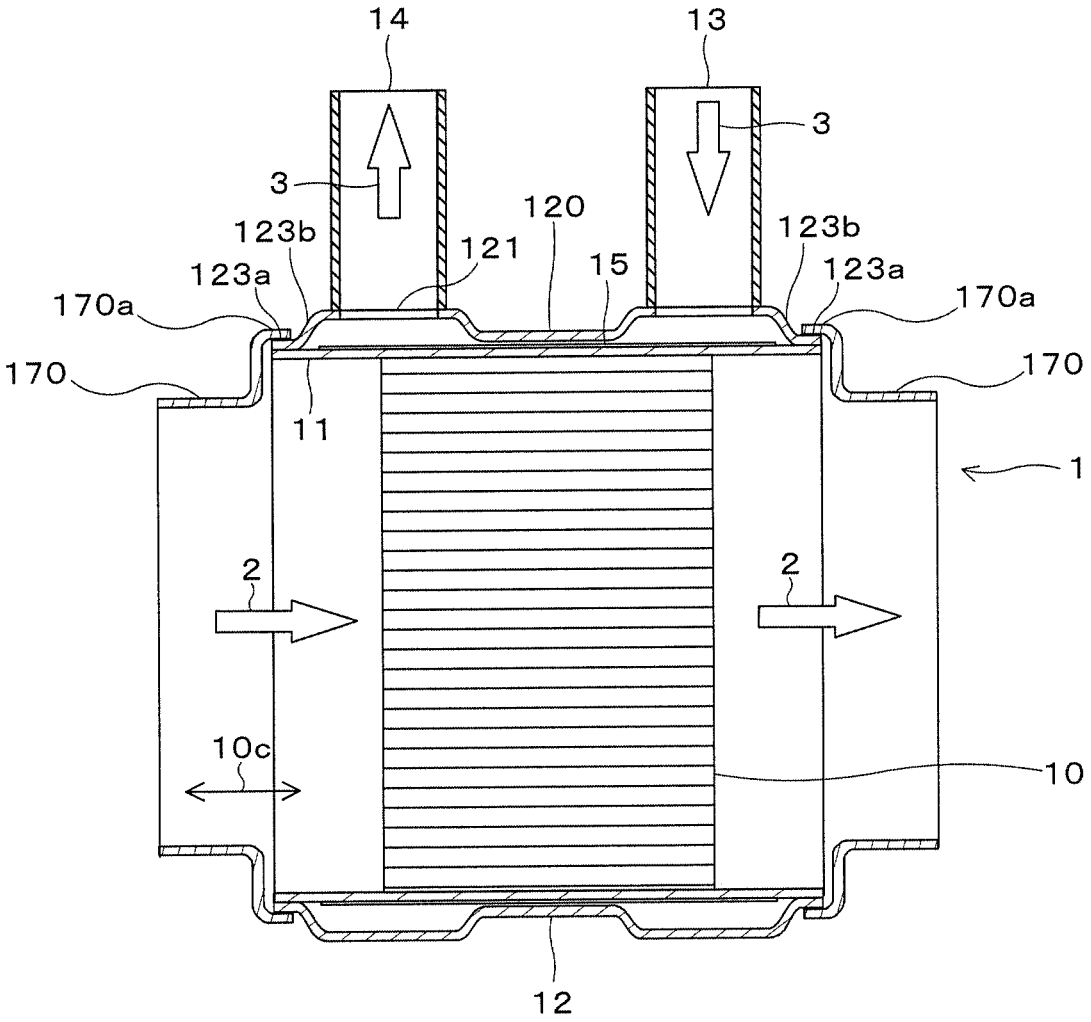

[FIG. 12]
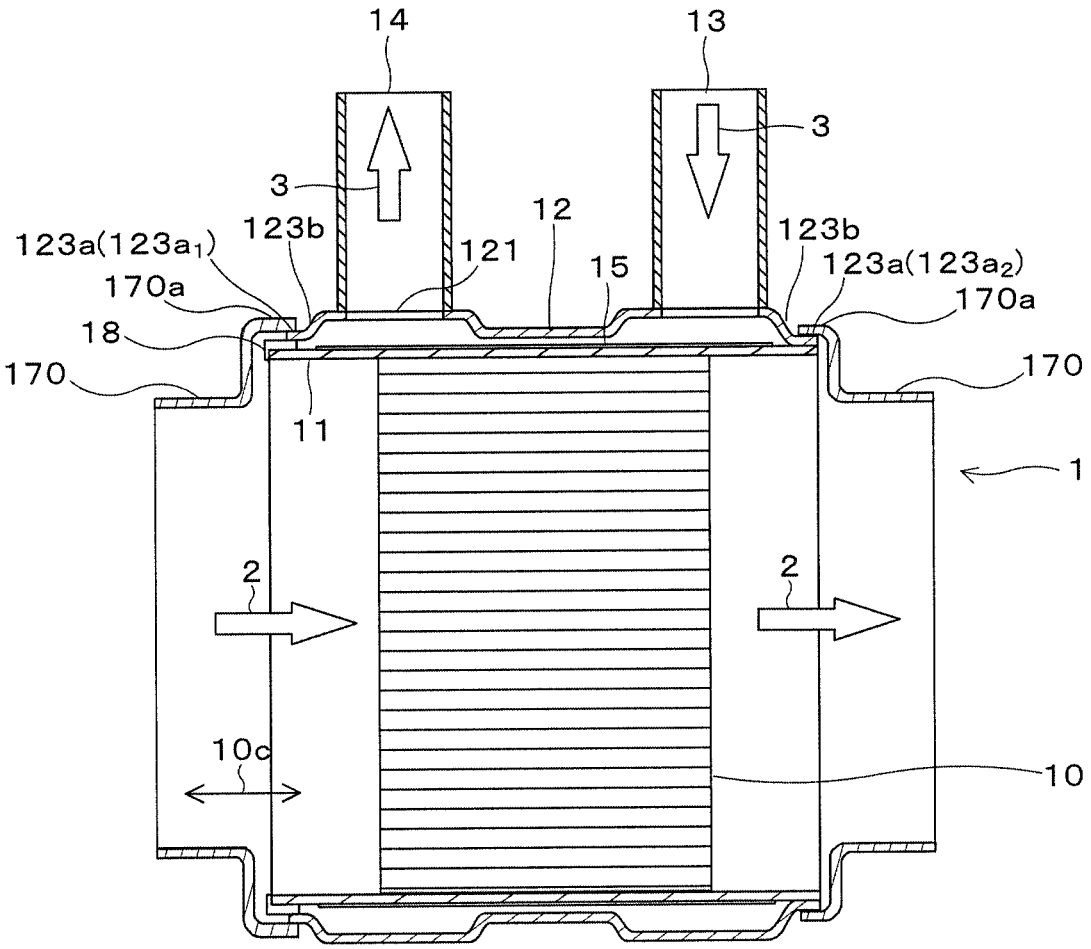

[FIG. 13]
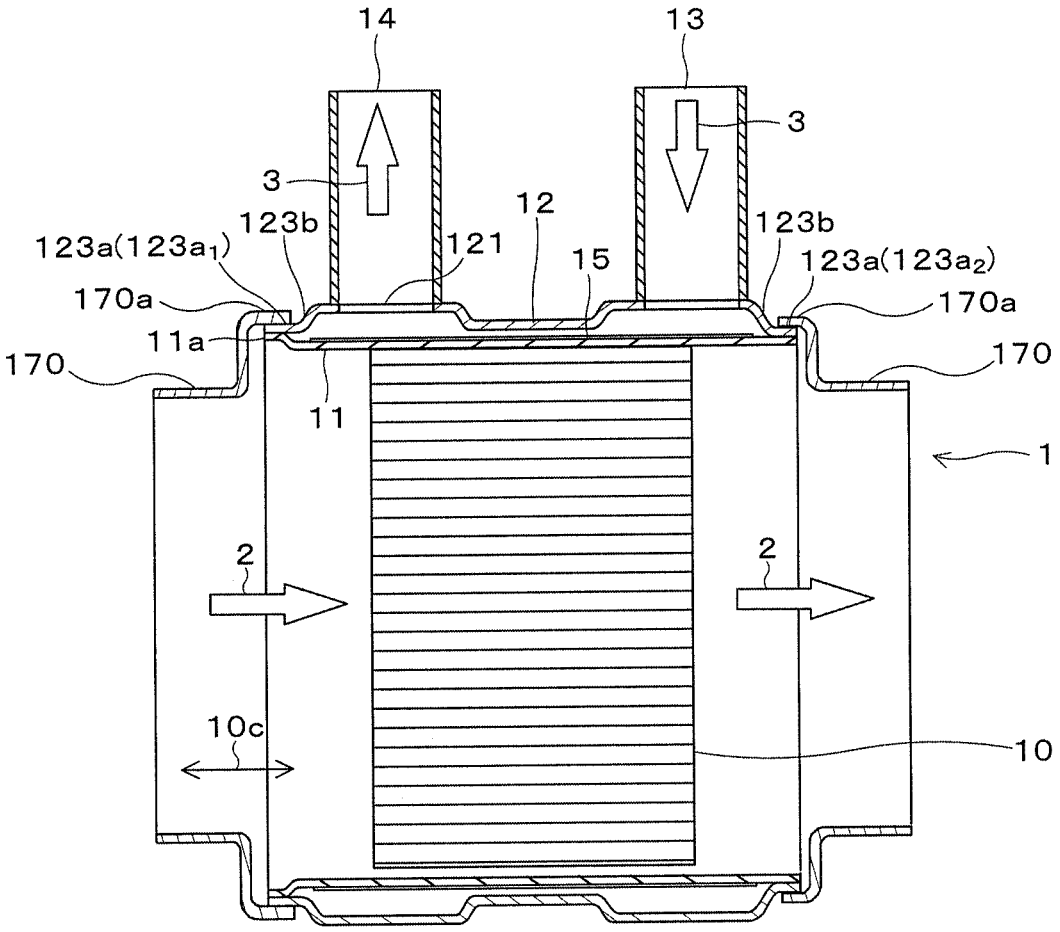

[FIG. 14]
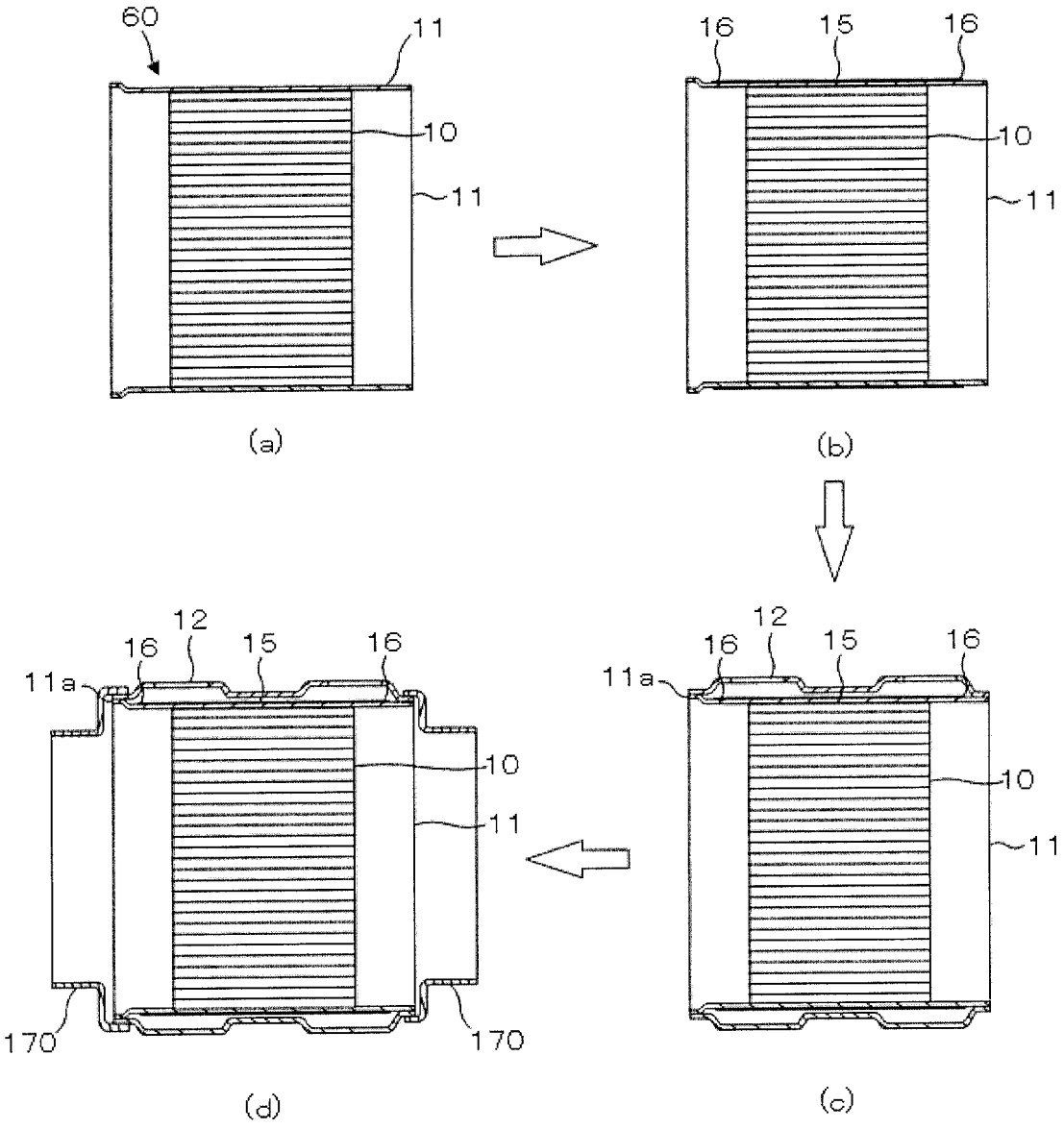

[FIG. 15]
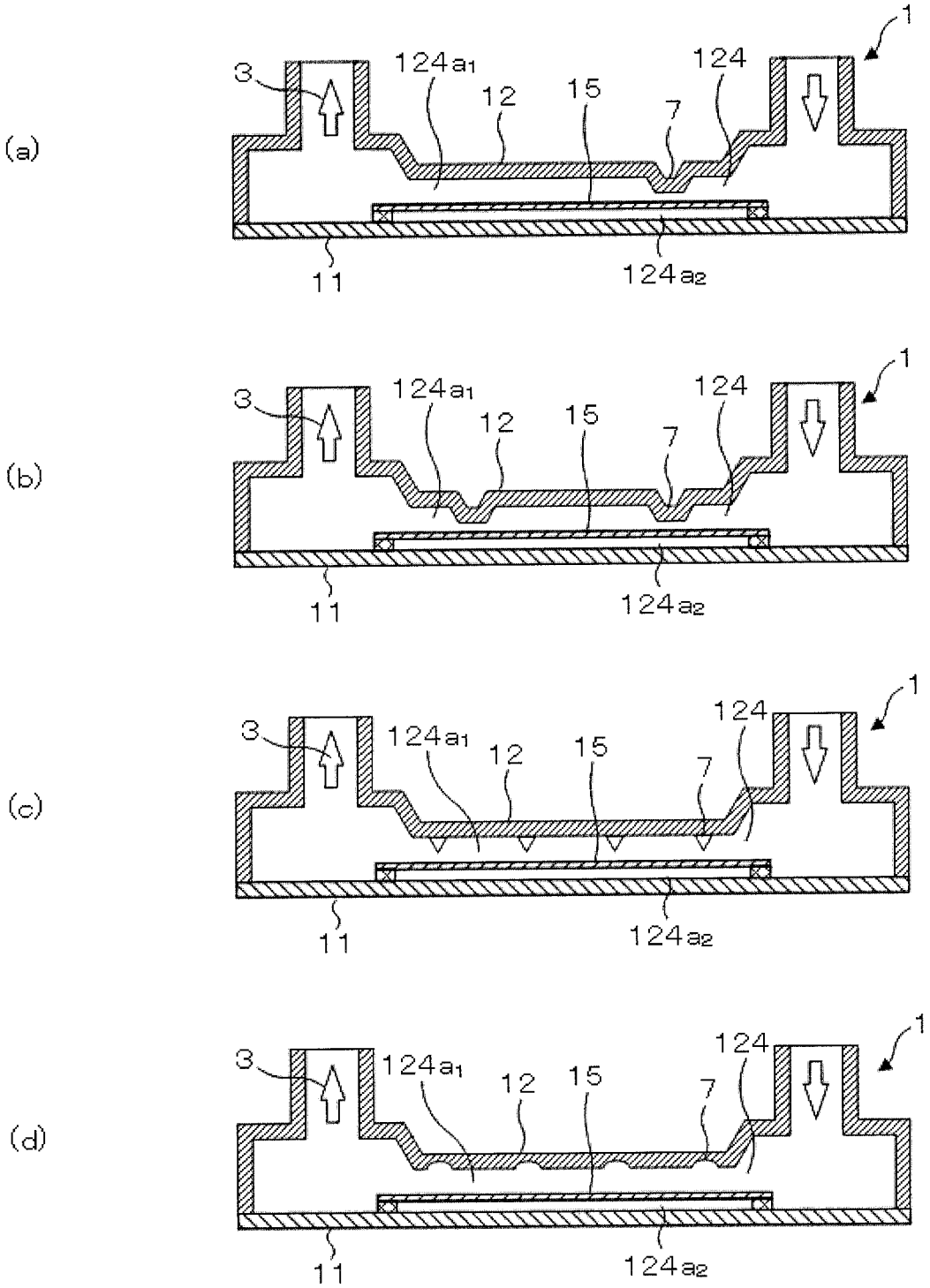

[FIG. 16]
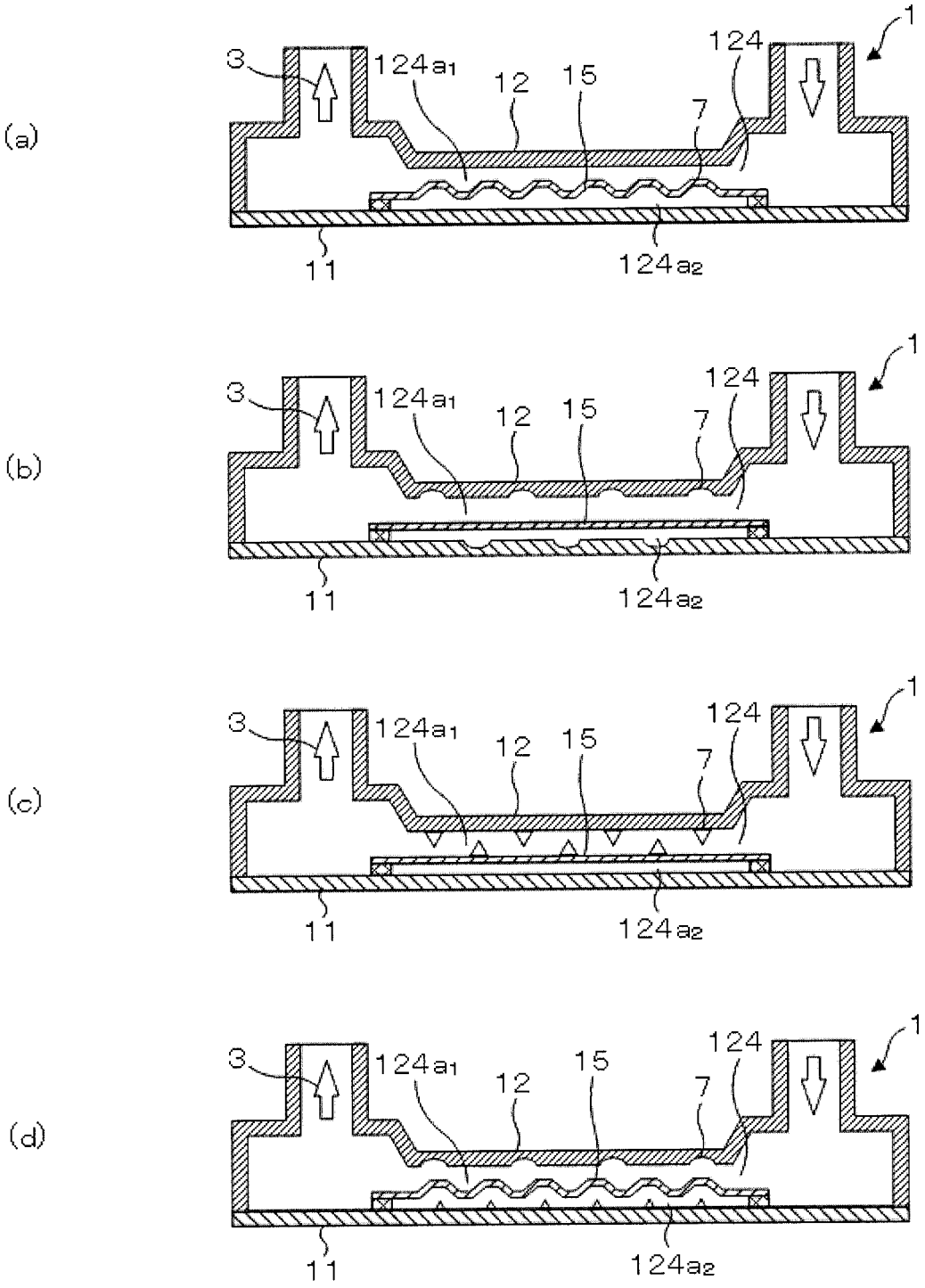

[FIG. 17]
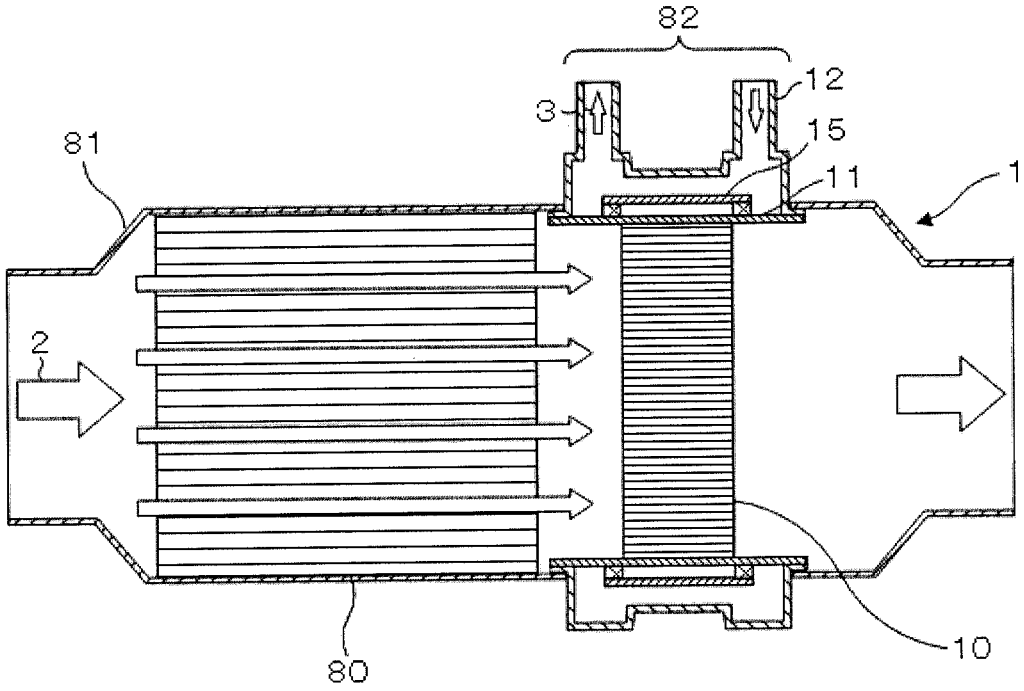

[FIG. 18]
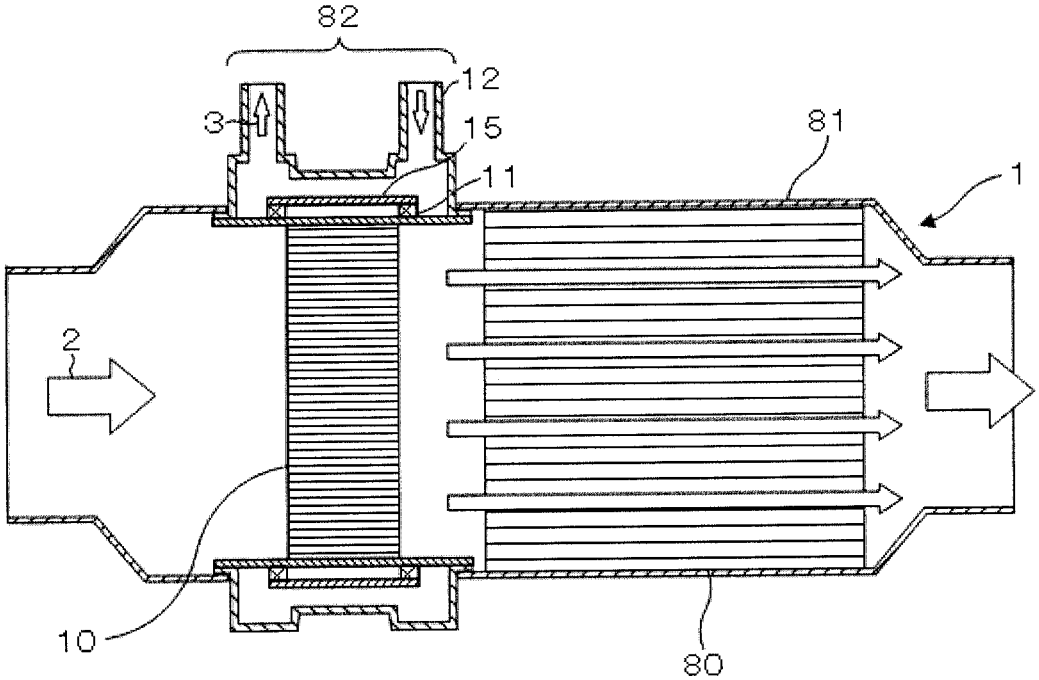

[FIG. 19]
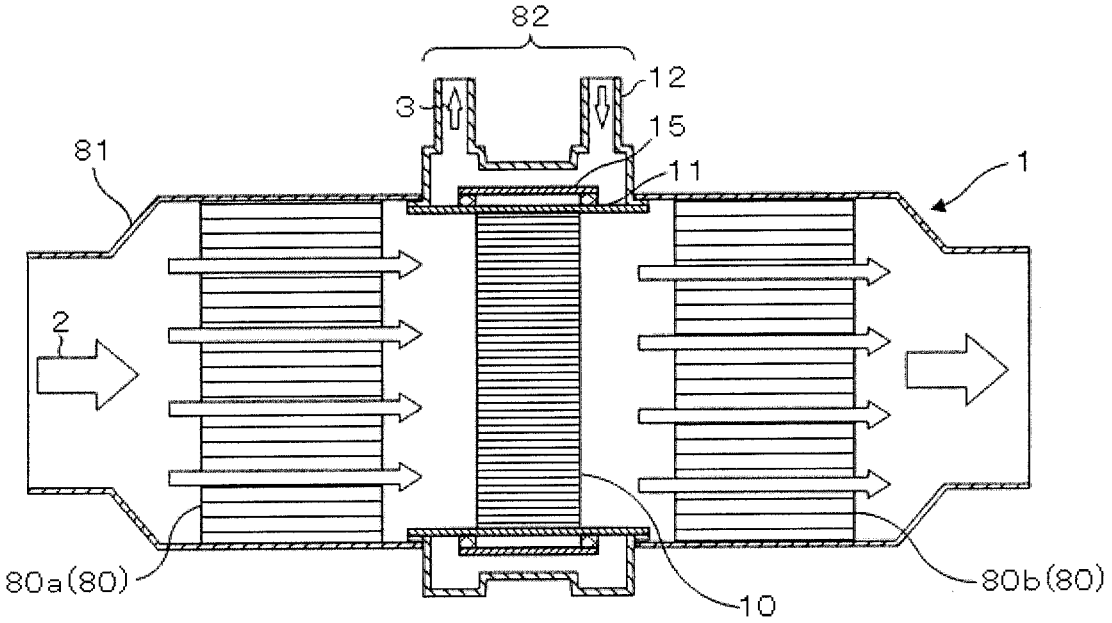

[FIG. 20]
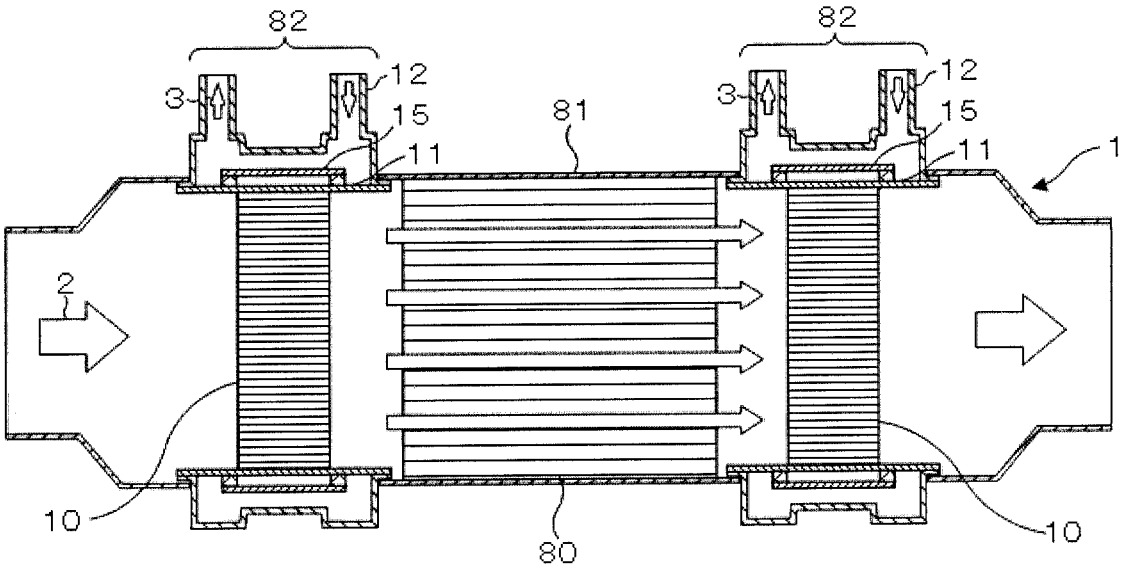

HEAT EXCHANGER

TECHNICAL FIELD

The present invention relates to a heat exchanger that performs heat exchange between a first fluid and a second fluid.

BACKGROUND ART

Recently, there has been a need for improvement of fuel economy of motor vehicles. Particularly, there has been a need for a system that can reduce friction loss by early warming up cooling water, an engine oil, ATF (Automatic Transmission Fluid) or like in order to prevent deterioration of fuel economy when the engine is cold, such as when the engine is started. Further, there has been a need for a system that heats a catalyst in order to activate a catalyst for cleaning an exhaust gas at an early stage.

An example of such a system is a heat exchanger. The heat exchanger is a device including a component (a heat exchange component) that performs heat exchange between a first fluid and a second fluid by allowing the first fluid to flow internally and the second fluid to flow externally. In such a heat exchanger, heat can be effectively utilized by heat exchange from a higher temperature fluid (for example, the exhaust gas or the like) to a lower temperature fluid (for example, the cooling water).

Patent Document 1 as described below discloses a heat exchange member capable of improving fuel economy of a motor vehicle when recovering waste heat from an exhaust gas and using the heat for warming up an engine in the field of the motor vehicle. The heat exchange member disclosed in Patent Document 1 includes: a pillar shaped honeycomb structure having a plurality of cells; and a casing arranged on an outer peripheral side of the honeycomb structure. A first fluid is passed through the cells of the honeycomb structure and a second fluid is passed between the honeycomb structure and the casing. An inlet for the second fluid to the casing and an outlet for the second fluid from the casing are arranged on the same side relative to the honeycomb structure. Therefore, in the heat exchange member disclosed in Patent Document 1, the heat exchange between the first fluid and the second fluid occurs while circulating the second fluid around the outer periphery of the honeycomb structure. Further, Patent Document 1 illustrates an embodiment where a height of a flow path between the honeycomb structure and the casing is uniform in an axial direction of the honeycomb structure.

CITATION LIST

Patent Literature

Patent Document 1: Japanese Patent Application Publication No. 2012-037165 A

SUMMARY OF INVENTION

When the height of the flow path is uniformly increased in the above conventional heat exchanger, there will be many second fluids that will not be subjected to heat exchange. In this case, a temperature of the second fluid will be difficult to rise, and a heat exchange efficiency will be deteriorated. On the other hand, when the height of the flow path is uniformly decreased, the second fluid that is not subjected to heat exchange can be decreased, but the second fluid may not be thoroughly distributed in a circumferential direction of the honeycomb structure. If the second fluid is not thoroughly distributed in the circumferential direction of the honeycomb structure, the entire circumferential surface of the honeycomb structure cannot be utilized for heat exchange, and the heat exchange efficiency is also deteriorated.

The present invention has been made to solve the above problems. One of objects of the present invention is to provide a heat exchanger that can have an improved heat exchange efficiency.

In one embodiment, a heat exchanger according to the present invention comprises: a pillar shaped honeycomb structure having a plurality of cells, the cells providing first flow paths through which a first fluid is passed; an inner cylinder attached to an outer periphery of the honeycomb structure; and an outer cylinder disposed on an outer periphery of the inner cylinder, the outer cylinder providing a second flow path through which a second fluid is passed, the second flow path being arranged between the outer cylinder and the inner cylinder, wherein the second flow path comprises: an intermediate flow path extending in an axial direction of the honeycomb structure so as to include an outer peripheral position of the honeycomb structure; and side flow paths located on both sides of the intermediate flow path in the axial direction, and wherein the intermediate flow path has a height lower than that of each of the side flow paths.

According to one embodiment of the heat exchanger according to the present invention, the height of the intermediate flow path is lower than that of each side flow paths, so that the second fluid can be thoroughly distributed in the side flow paths in the circumferential direction of the honeycomb structure, and an amount of the second fluid that is not subjected to the heat exchange can be decreased in the intermediate flow path, thereby improving the heat exchange efficiency.

BRIEF DESCRIPTION OF DRAWINGS

FIG. 1 is a cross-sectional view of a heat exchanger according to Embodiment 1 of the present invention.

FIG. 2 is a front view of a honeycomb structure, an inner cylinder and an intermediate cylinder when viewing the inner cylinder and the intermediate cylinder in FIG. 1 along an axial direction of the honeycomb structure.

FIG. 3 is an explanatory view showing a variation of the honeycomb structure in FIG. 2.

FIG. 4 is an explanatory view showing a positional relationship between a supply pipe and a discharge pipe in FIG. 1.

FIG. 5 is an explanatory view showing a variation of the positional relationship between the supply pipe and the discharge pipe in FIG. 4.

FIG. 6 is an enlarged cross-sectional view of a heat exchanger showing a region VI in FIG. 1.

FIG. 7 is a graph showing a relationship between heat shielding performance and heat recovery performance when changing a ratio of a height of a main flow path to a height of a sub flow path in FIG. 6.

FIG. 8 is an explanatory view showing then intermediate cylinder in FIG. 1 in more detail.

FIG. 9 is a cross-sectional view of a heat exchanger according to Embodiment 2 of the present invention.

FIG. 10 is an explanatory view showing a relationship between an inner cylinder/an intermediate cylinder and a spacer in a heat exchanger according to Embodiment 3 of the present invention.

FIG. 11 is a cross-sectional view of a heat exchanger according to Embodiment 4 of the present invention.

FIG. 12 is a cross-sectional view of a heat exchanger according to Embodiment 5 of the present invention.

FIG. 13 is a cross-sectional view of a heat exchanger according to Embodiment 6 of the present invention.

FIG. 14 is a cross-sectional view for explaining a method for producing the heat exchanger in FIG. 13.

FIG. 15 is a cross-sectional view of a main part of a heat exchanger according to Embodiment 7 of the present invention.

FIG. 16 is a cross-sectional view showing a variation of the main part of the heat exchanger in FIG. 15.

FIG. 17 is a cross-sectional view of a heat exchanger according to Embodiment 8 of the present invention.

FIG. 18 is a cross-sectional view of a heat exchanger according to Embodiment 9 of the present invention.

FIG. 19 is a cross-sectional view of a heat exchanger according to Embodiment 10 of the present invention.

FIG. 20 is a cross-sectional view of a heat exchanger according to Embodiment 11 of the present invention.

DESCRIPTION OF THE PREFERRED EMBODIMENTS

Hereinafter, embodiments for carrying out the present invention will be described with reference to the drawings. It should be understood that the present invention is not limited to the embodiments, and it can be embodied by modifying elements without departing from the spirit of the present invention. Further, various inventions may be formed by appropriately combining a plurality of elements disclosed in the respective embodiments. For example, some elements may be deleted from all elements shown in the embodiments. Further, elements of different embodiments may be optionally combined.

Embodiment 1

FIG. 1 is a cross-sectional view of a heat exchanger 1 according to Embodiment 1 of the present invention, FIG. 2 is a front view of a honeycomb structure 10, an inner cylinder 11 and an intermediate cylinder 15 when viewing the inner cylinder 11 and the intermediate cylinder 15 in FIG. 1 along an axial direction 10*c* of the honeycomb structure 10, FIG. 3 is an explanatory view showing a variation of the honeycomb structure 10 in FIG. 2, FIG. 4 is an explanatory view showing a positional relationship between a supply pipe 13 and a discharge pipe 14 in FIG. 1, FIG. 5 is an explanatory view showing a variation of the positional relationship between the supply pipe 13 and the discharge pipe 14 in FIG. 4, FIG. 6 is an enlarged cross-sectional view of the heat exchanger 1 showing a region VI in FIG. 1, and FIG. 7 is a graph showing a relationship between heat shielding performance and heat recovery performance when changing a ratio of a height of a main flow path 124$a_1$ to a height of a sub flow path 124$a_2$ in FIG. 6.

The heat exchanger 1 shown in FIG. 1 is an apparatus for performing heat exchange between a first fluid 2 and a second fluid 3. As the first and second fluids 2, 3, various liquids and gases can be used. When the heat exchanger 1 is mounted on a motor vehicle, an exhaust gas can be used as the first fluid 2 and water or an antifreeze solution (LLC defined in JIS K 2234: 2006) can be used as the second fluid 3. The first fluid 2 may be a fluid having a higher temperature than the second fluid 3.

The heat exchanger 1 according to the present embodiment is provided with the honeycomb structure 10, the inner cylinder 11, an outer cylinder 12, the supply pipe 13, the discharge pipe 14, the intermediate cylinder 15, spacers 16, and covers 17.

<Regarding Honeycomb Structure>

The honeycomb structure 10 according to the present embodiment is a pillar shaped structure. A cross-sectional shape of the honeycomb structure 10 may be a circle, an ellipse, a rectangle, or other polygon. The honeycomb structure 10 according to the present embodiment is a cylindrical structure.

As particularly shown in FIGS. 1 and 2, the honeycomb structure 10 is provided with a plurality of cells 101 partitioned from each other by partition walls 100 mainly based on ceramics. Each cell 101 passes through the inside of the honeycomb structure 10 from a first end face 10*a* to a second end face 10*b* of the honeycomb structure 10. The first and second end faces 10*a*, 10*b* are end surfaces on both sides of the honeycomb structure 10 in an axial direction 10*c* of the honeycomb structure 10. It should be understood that the axial direction 10*c* of the honeycomb structure 10 is an extending direction of the cells 101.

The first fluid 2 according to the present embodiment is allowed to flow along the axial direction 10*c* of the honeycomb structure 10 and passes through the honeycomb structure 10 through the respective cells 101 from the first end face 10*a* to the second end face 10*b*. That is, each cell 101 provides a first flow path through which the first fluid 2 passes. It should be noted that FIG. 1 shows a cross section of the heat exchanger 1 in a plane orthogonal to the first flow path or the axial direction 10*c*.

In FIG. 2, the cross-sectional shape of each cell 101 is illustrated to be quadrangular, but the cross-sectional shape of each cell 101 may be any shape such as a circle, an ellipse, a sector, a triangle or a polygon equal to or more than a pentagon. As shown in FIG. 3, the respective cells 101 may be radially provided on a plane orthogonal to the first flow path or the axial direction 10*c*.

Each cell 101 of the honeycomb structure 10 shown in FIG. 3 has a fan cross-sectional shape, and the respective cells 101 are provided in a radial pattern around the center axis of the honeycomb structure 10.

The cells 101 shown in FIG. 3 are formed by a plurality of first partitions 100*a* and a plurality of second partitions 100*b*. The first partition walls 100*a* extend in the radial direction of the honeycomb structure 10, spaced apart from one another in the circumferential direction of the honeycomb structure 10. The second partition walls 100*b* extend in the circumferential direction of the honeycomb structure 10, spaced apart from one another in the radial direction of the honeycomb structure 10. The first and second partitions 100*a*, 100*b* intersect. In FIG. 3, the first partition walls 100*a* are shown as linear walls radially extending. However, the first partition wall 100*a* may adopt other forms such as, for example, a curved wall extending in a radial pattern or a straight wall extending obliquely in the radial direction of the honeycomb structure 10.

It is preferable that the first partition walls 100*a* that define one cell 101 are longer than the second partition walls 100*b* that define one cell 101. Since the first partition walls 100*a* contribute to thermal conductivity in the radial direction, such a configuration can allow efficient transmission of heat of the first fluid 2 flowing through the cells 101 toward a radially outer side of the honeycomb structure 10.

It is preferable that the first partition wall 100*a* is thicker than the second partition wall 100*b*. Since the thickness of the partition wall 100 correlates with the thermal conductivity, such a configuration can allow the thermal conductivity of the first partition wall 100*a* to be higher than the thermal conductivity of the second partition wall 100*b*. As a result, the heat of the first fluid 2 flowing through the cells 101 can be efficiently transmitted toward the radially outer side of the honeycomb structure 10.

An outer peripheral wall 103 of the honeycomb structure 10 is preferably thicker than the partition walls 100 (the first partition walls 100*a* and the second partition walls 100*b*). Such a configuration can allow improvement of strength of the outer peripheral wall 103 which would otherwise tend to generate breakage (for example, cracks, chinks, and the like) due to an impact from the outside or thermal stress based on a temperature difference between the first fluid 2 and the second fluid 3.

The thickness of the partition wall 100 (the first partition walls 100*a* and the second partition walls 100*b*) is not particularly limited and may be adjusted as needed according to applications and the like. The thickness of the partition wall 100 is preferably from 0.1 to 1 mm, and more preferably 0.2 to 0.6 mm. The thickness of the partition wall 100 of 0.1 mm or more can lead to sufficient mechanical strength of the honeycomb structure 10. Further, the thickness of the partition wall 100 of 1 mm or less can allow prevention of problems that a pressure loss is increased due to a decrease in an opening area and a heat recovery efficiency is decreased due to a decrease in a contact area with the first fluid 2.

The space between the adjacent first partition walls 100*a* will be narrower in the circumferential direction as it is a radially inner side of the honeycomb structure 10, which may be difficult to form the cells 101. When the cells 101 are not formed radially inward or when the cross-sectional areas of the cells 101 formed on the inner side in the radial direction is too low, the pressure loss of the heat exchanger 1 will be increased.

From the viewpoint of preventing such problems, in the cross section of the honeycomb structure 10 in the plane orthogonal to the first flow path or the axial direction 10*c*, the number of the first partition walls 100*a* on the radially inner side of the honeycomb structure 10 is lower than the number of the first partitions 100*a* on the radially outer side. Such a configuration can allow the cells 101 to be stably formed even on the radially inner side of the honeycomb structure 10. This can allow suppression of an increase in the pressure loss of the heat exchanger 1 caused by difficulty in forming the cells 101 on the radially inner side of the honeycomb structure 10.

It should be noted that the number of the first partition walls 100*a* on the radially inner side or the radially outer side of the honeycomb structure 10 refers to the total number of the first partition walls 100*a* included in each annular region (circumferential region) defined by the second partition walls 100*b* and the outer peripheral wall 103 adjacent to each other in the radial direction of the honeycomb structure 10, in the cross section of the honeycomb structure 10. It is preferable that the total number of the first partition walls 100*a* in the annular region located on the innermost side in the radial direction of the honeycomb structure 10 is higher than the total number of the first partition walls 100*a* in the annular region located on the outermost side in the radial direction of the honeycomb structure 10. It is also preferable that the total number of the first partition walls 100*a* in each annular region is decreased as it goes inward in the radial direction of the honeycomb structure 10. The total number of the first partition walls 100*a* may be continuously decreased toward the inner side in the radial direction of the honeycomb structure 10 or may be decreased in a stepwise manner toward the inner side in the radial direction of the honeycomb structure 10 (i.e., the number of the first partitions 100*a* in the annular region, adjacent to each other in the radial direction of the honeycomb structure 10, may be the same). Since the space between the adjacent first partition walls 100*a* has to be narrower as it approaches the radially inner side of the honeycomb structure 10, it will be difficult to form the cells 101. However, the structure as described above can allow the space between the adjacent first partition walls 100*a* to be ensured, so that the cells 101 can be stably formed. Therefore, an increase in the pressure loss of the heat exchanger 1 can be suppressed.

The honeycomb structure 10 shown in FIG. 3 can be produced by extruding a green body containing SiC powder into a desired shape, drying it, processing it into a predetermined external dimensions, and impregnating it with Si and firing it. The honeycomb structure 10 has a pillar shape, and has a diameter (outer diameter) of 70 mm, and a length in the flow path direction for the first fluid of 40 mm. Further, the honeycomb structure 10 has the cell 101 defined only by the second partition wall 100*b* in the center portion, and has numbers of cells 101 of 200 in a circumferential region A, 100 in a circumferential region B, 50 in a circumferential region C, 25 in a circumferential region D, and 5 in a circumferential region E. The number of the first partition walls 100*a* on the radially inner side is less than the number of the first partition walls 100*a* on the radially outer side. The shape as described above can allow the cells 101 to be formed even on the central portion side of the honeycomb structure 10.

<Regarding Inner Cylinder>

The inner cylinder 11 according to the present embodiment is a cylindrical member attached to the outer periphery of the honeycomb structure 10. The inner cylinder 11 according to the present embodiment is fixed to the outer periphery of the honeycomb structure 10 in a state where an inner peripheral surface of the inner cylinder 11 is in contact with the outer peripheral surface of the honeycomb structure 10. That is, the cross-sectional shape of the inner peripheral surface of the inner cylinder 11 according to the present embodiment agrees with the cross-sectional shape of the outer peripheral surface of the honeycomb structure 10. The axial direction of the inner cylinder 11 of the present embodiment agrees with the axial direction 10*c* of the honeycomb structure 10. It is preferable that the central axis of the inner cylinder 11 agrees with the central axis of the honeycomb structure 10. The length of the inner cylinder 11 in the axial direction 10*c* of the honeycomb structure 10 is longer than the length of the honeycomb structure 10 in the axial direction 10*c* of the honeycomb structure 10. It is preferable that the center positions of the honeycomb structure 10 and the inner cylinder 11 in the axial direction 10*c* of the honeycomb structure 10 are coincident with each other. The inner diameter of the inner cylinder 11 according to the present embodiment is uniform in the axial direction 10*c* of the honeycomb structure 10 and the peripheral wall of the inner cylinder 11 extends linearly in the axial direction 10*c* of the honeycomb structure 10.

The heat of the first fluid 2 passing through the honeycomb structure 10 is transmitted to the inner cylinder 11 through the honeycomb structure 10. A material of the inner cylinder 11 that can be preferably used includes a material having higher thermal conductivity, for example, metals, ceramics or the like. Examples of the metals that can be used include stainless steel, titanium alloys, copper alloys, aluminum alloys, brass and the like. For the reason that the durability and reliability is higher, the material of the inner cylinder 11 is preferably stainless steel.

From the inner peripheral surface of the inner cylinder 11 according to the present embodiment, protruding portions 110 protrude radially inward of the inner cylinder 11. The protruding portions 110 are disposed at positions where they are in contact with the first and second end faces 10*a*, 10*b* of the honeycomb structure 10 in the axial direction 10*c* of the honeycomb structure 10, respectively. By providing such protruding portions 110, displacement of the honeycomb structure 10 in the axial direction 10 *c* is restricted. Each protruding portion 110 according to the present embodiment is configured to fix a stainless steel ring member to the inner peripheral surface of the inner cylinder 11 by welding and extend in the entire circumferential direction of the inner cylinder 11. However, each protruding portion 110 may not extend in the entire circumferential direction of the inner cylinder 11, and may protrude from the inner peripheral surface of the inner cylinder 11 at one or more positions in the circumferential direction of the inner cylinder 11.

<Regarding Outer Cylinder, Supply Pipe and Discharge Pipe>

The outer cylinder 12 according to the present embodiment is a cylindrical member arranged on the outer periphery of the inner cylinder 11. The axial direction of the outer cylinder 12 according to the present embodiment agrees with the axial direction 10*c* of the honeycomb structure 10. It is preferable that the central axis of the outer cylinder 12 coincides with the central axis of the honeycomb structure 10. The length of the outer cylinder 12 in the axial direction 10*c* of the honeycomb structure 10 is longer than the length of the honeycomb structure 10 in the axial direction 10*c* of the honeycomb structure 10. Further, the length of the outer cylinder 12 in the axial direction 10*c* is equal to the length of the inner cylinder 11 in the axial direction 10*c*.

The outer cylinder 12 according to the present embodiment includes a central peripheral wall 120, a pair of expanded diameter peripheral walls 121, a pair of connecting peripheral walls 122, and a pair of end walls 123.

The central peripheral wall 120 is an annular wall extending in a center portion of the outer cylinder 12 in the axial direction of the outer cylinder 12 (the axial direction 10*c* of the honeycomb structure 10). An inner diameter of the central peripheral wall 120 is larger than an outer diameter of the inner cylinder 11. The central peripheral wall 120 is disposed so as to include an outer peripheral position of the honeycomb structure 10. The outer peripheral position of the honeycomb structure 10 refers to a position which is outside the outer peripheral surface of the honeycomb structure 10 and which is between the first end face 10*a* and the second end face 10*b* of the honeycomb structure 10 in the axial direction 10*c* of the honeycomb structure 10. It is preferable that the central positions of the honeycomb structure 10 and the central peripheral wall 120 in the axial direction 10*c* of the honeycomb structure 10 agree with each other.

Each expanded diameter peripheral wall 121 is an annular wall portion where the honeycomb structure 10 is provided on both sides of the central peripheral wall 120 in the axial direction 10*c*. The inner diameter of each expanded diameter peripheral wall 121 is larger than the inner diameter of the central peripheral wall 120. In the present embodiment, the inner diameter of one expanded diameter peripheral wall 121 in the axial direction of the outer cylinder 12 and the inner diameter of the other expanded diameter peripheral wall 121 in the axial direction of the outer cylinder 12 are matched with each other. However, these inner diameters may be different from each other.

Each connecting peripheral wall 122 is an annular wall portion connecting the central peripheral wall 120 to the expanded diameter peripheral wall 121. Each connecting peripheral wall 122 according to the present embodiment extends so as to be inclined with respect to the axial direction and the radial direction of the outer cylinder 12. The cross-sectional shape of each connecting peripheral wall 122 may be either a curved shape or a linear shape.

Each end wall 123 is an annular wall portion that protrudes radially inward of the outer cylinder 12 from an end portion of the expanded diameter peripheral wall 121. A tip of each end wall 123 abuts against the outer peripheral surface of the inner cylinder 11. The tip of each end wall 123 is fixed to the outer peripheral surface of the inner cylinder 11 such as by welding or the like, so that the outer cylinder 12 is fixed to the inner cylinder 11.

As described above, the inner diameter of each of the peripheral walls 120 to 122 of the outer cylinder 12 is larger than the outer diameter of the inner cylinder 11, and between the outer peripheral surface of the inner cylinder 11 and the inner peripheral surface of the outer cylinder 12 is a space where the honeycomb structure 10 extends in the axial direction 10*c* and the circumferential direction.

The supply pipe 13 is connected to one expanded diameter peripheral wall 121 in the axial direction of the outer cylinder 12, and the discharge pipe 14 is connected to the other expanded diameter peripheral wall 121 in the axial direction of the outer cylinder 12. The supply pipe 13 is a pipe for supplying the second fluid 3 to the space between the inner cylinder 11 and the outer cylinder 12. The discharge pipe 14 is a pipe for discharging the second fluid 3 from the space between the inner cylinder 11 and the outer cylinder 12. That is, the outer cylinder 12 according to the present embodiment provides a second flow path 124 through which the second fluid 3 is passed. The second flow path 124 is arranged between the outer cylinder 12 and the inner cylinder 11.

As shown in FIGS. 1 and 4, in the present embodiment, the supply pipe 13 and the discharge pipe 14 extend from the outer cylinder 12 in the same direction. However, as shown in FIG. 5, the extending direction of the supply pipe 13 from the outer cylinder 12 may be different from the extending direction of the discharge pipe 14 from the outer cylinder 12, and further may be a direction opposite to the extending direction of the discharge pipe from 14 from the outer cylinder 12. However, it is preferable that the discharge pipe 14 extends upward in the vertical direction from the outer cylinder 12 such that air bubbles in the second flow path 124 can be more reliably discharged from the discharge pipe 14. Although the discharge pipe 14 is preferably along in the vertical direction, the discharge pipe 14 may be inclined with respect to the vertical direction to extend upward in the vertical direction from the outer cylinder 12.

As particularly shown in FIG. 4, in this embodiment, the supply pipe 13 and the discharge pipe 14 are arranged at different positions in the circumferential direction of the honeycomb structure 10. However, the supply pipe 13 and the discharge pipe 14 may be arranged at the same position in the circumferential direction of the honeycomb structure 10. In FIG. 1, to facilitate understanding of the contents, the supply pipe 13 and the discharge pipe 14 are shown in a cross section at each position.

The second flow path 124 according to the present embodiment includes an intermediate flow path 124*a*, a supply-side side flow path 124*b*, and a discharge-side side flow path 124*c*.

The intermediate flow path 124*a* is a flow path formed between the inner cylinder 11 and the central peripheral wall 120 of the outer cylinder 12 and extends in the axial direction 10*c* of the honeycomb structure 10 so as to include the outer peripheral position of the honeycomb structure 10.

The supply-side side flow path 124*b* is a flow path formed between the expanded diameter peripheral wall 121 of the outer cylinder 12 to which the supply pipe 13 is connected and the inner cylinder 11. The discharge-side side flow path 124*c* is a flow path formed between the expanded diameter peripheral wall 121 of the outer cylinder 12 to which the discharge pipe 14 is connected and the inner cylinder 11. The supply-side side flow path 124*b* and the discharge-side side flow path 124*c* form side flow paths located on both sides of the intermediate flow path 124*a* in the axial direction 10*c* of the honeycomb structure 10.

The second fluid 3 from the supply pipe 13 is reserved in the supply-side side flow path 124*b* and flows into the discharge-side side flow path 124*c* through the intermediate flow path 124*a*, and is discharged from the discharge pipe 14 to the outside of the heat exchanger 1. As described above, the heat of the first fluid 2 is transmitted to the inner cylinder 11 through the honeycomb structure 10. When the second fluid 3 mainly passes through the intermediate flow path 124*a*, heat exchange occurs between the second fluid 3 and the inner cylinder 11 (the first fluid 2).

As described above, in the present embodiment, the inner diameter of the expanded diameter peripheral wall 121 is larger than the inner diameter of the central peripheral wall 120. Therefore, the height of the intermediate flow path 124*a* is lower than the heights of the supply-side side flow path 12*b* and the discharge-side side flow path 124*c*. Therefore, the second fluid 3 can be thoroughly distributed in the supply-side side flow path 124*b* and the discharge-side side flow path 124*c* in the circumferential direction of the honeycomb structure 10, and the second fluid 3 that is not subjected to the heat exchange in the intermediate flow path 124*a* can be reduced to improve a heat exchange efficiency. The reducing of the second fluid 3 that is not subjected to the heat exchange in the intermediate flow path 124*a* is particularly useful for improving the heat exchange efficiency (heat recovery efficiency) at the time of a lower heat load in which the temperature of the honeycomb structure 10 is lower. The heights of the intermediate flow path 124*a*, the supply-side side flow path 124*b*, and the discharge-side side flow path 124*c* can be defined by a distance between the outer peripheral surface of the inner cylinder 11 and the inner peripheral surface of the outer cylinder 12 in the normal direction of the outer peripheral surface of the inner cylinder 11.

Since the height of the intermediate flow path 124*a* is lower than the heights of the supply-side side flow path 124*b* and the discharge-side side flow path 124*c*, the flow rate of the second fluid 3 at the outer peripheral position of the honeycomb structure 10 can be improved.

That is, a volumetric flow rate [$m^3$/s] is expressed by product of a flow path cross-sectional area [$m^2$] and a flow rate [m/s] as shown in the following equation:

Volumetric flow rate [$m^3$/s]=flow path cross-sectional area [$m^2$]×flow rate [m/s]

In the absence of leakage, the volumetric flow rates [$m^3$/s] flowing through one cross section in the intermediate flow path 124*a* and one cross section in the supply-side side flow path 124*b* are the same as each other. When a fluid is to flow through one cross section in the intermediate flow path 124*a* and one cross section in the supply-side side flow path 124*b* at the same flow rate, one cross section in the intermediate flow path 124*a* is smaller than one cross section in the supply-side side flow path 124*b*, so that the fluid flows more quickly in one cross section in the intermediate flow path 124*a*. Therefore, as described above, the flow rate of the second fluid 3 at the outer peripheral position of the honeycomb structure 10 is improved.

In the intermediate flow path 124*a*, the second fluid 3 flows in parallel to the first fluid 2. In other words, the second fluid 3 flows in the axial direction 10*c* of the honeycomb structure 10 in the intermediate flow path 124*a*. Although it is preferable that the second fluid 3 linearly flows in the axial direction 10*c* from the supply-side side flow path 124*b* toward the discharge-side side flow path 124*c*, the second fluid 3 may flow in a spiral manner in the axial direction 10*c* and the circumferential direction of the honeycomb structure 10 from the supply-side side flow path 124*b* to the discharge-side side flow path. That is, the flowing of the second fluid 3 in parallel to the first fluid 2 include not only the linearly flowing of the second fluid 3 in the axial direction 10*c*, but also the spiral flowing of the second fluid 3.

The height of the intermediate flow path 124*a* is set so as to reduce the second fluid 3 that is not subjected to the heat exchange. The height of the intermediate flow path 124*a* is preferably 0.2 mm or more and 33 mm or less. The height of the intermediate flow path 124*a* is a total value of the heights of a main flow path 124$a_1$ and a sub flow path 124$a_2$ which will be described below.

The magnification of the heights of the supply-side side flow path 124*b* and the discharge-side side flow path 124*c* to the height of the intermediate flow path 124*a* are set such that the second fluid 3 is allowable to flow in the supply-side side flow path 124*b* and the discharge-side side flow path 124*c* in the circumferential direction of the honeycomb structure 10. Further, the magnification is set such that the second fluid 3 flows smoothly in the intermediate flow path 124*a* from the supply-side side flow path 124*b* toward the discharge-side side flow path 124*c*. As the magnification of the heights of the supply-side side flow path 124*b* and the discharge-side side flow path 124*c* to the height of the intermediate flow path 124*a* are larger, the pressure loss of the supply-side side flow path 124*b* in the circumferential direction is decreased, so that the second fluid 3 can flow uniformly in the supply side-side flow path 124*b*. As a result, the second fluid 3 can flow uniformly in the intermediate flow path 124*a* in the circumferential direction. Further, since the pressure loss relating to the flow of the second fluid 3 from the intermediate flow path 124*a* to the discharge-side flow path 124*c* is reduced, the warmed second fluid 3 can be discharged in a shorter period of time from the intermediate flow path 124*a* to the discharge-side side flow path 124*c*, so that the heat collection efficiency can be improved. The heights of the supply-side side flow path 124*b* and the discharge-side side flow path 124*c* are preferably 1.1 times or more the height of the intermediate flow path 124*a*, and more preferably 3 times or more the height of the intermediate flow path 124*a*. If the magnification of the heights of the supply-side side flow path 124*b* and the discharge-side side flow path 124*c* to the height of the intermediate flow path 124*a* are too large, the size and weight of the heat exchanger 1 will be increased. The upper limit of the heights of the supply-side side flow path 124*b* and the discharge-side side flow path 124*c* can be determined according to an allowable size and weight of the heat exchanger 1.

The supply-side side flow path 124*b* according to the present embodiment is disposed on a downstream side of the discharge-side side flow path 124*c* in the flow direction of the first fluid 2 (the direction from the first end face 10*a* toward the second end face 10*b* of the honeycomb structure 10). That is, in the present embodiment, the second fluid 3 is reversed to the first fluid 2 in the intermediate flow path 124*a*. Therefore, as the second fluid 3 moves in the axial direction 10*c*, the second fluid 3 can exchange the heat to the first fluid 2 having a higher temperature, so that the heat exchange efficiency can be improved.

<Regarding Intermediate Cylinder>

The intermediate cylinder 15 according to the present embodiment is a cylindrical member disposed between the inner cylinder 11 and the outer cylinder 12 on the outer periphery of the honeycomb structure 10. The axial direction of the intermediate cylinder 15 according to this embodiment agrees with the axial direction 10*c* of the honeycomb structure 10. It is preferable that the central axis of the intermediate cylinder 15 coincides with the central axis of the honeycomb structure 10. In the axial direction 10*c* of the honeycomb structure 10, the intermediate cylinder 15 is longer than the honeycomb structure 10. It is preferable that the center positions of the honeycomb structure 10 and the intermediate cylinder 15 in the axial direction 10*c* of the honeycomb structure 10 are coincident with each other.

As particularly shown in FIG. 6, the intermediate cylinder 15 is disposed between the inner cylinder 11 and the outer cylinder 12, so that in the intermediate flow path 124*a*, the main flow path 124$a_1$ and the sub flow path 124$a_2$ are formed. The main flow path 124$a_1$ is a flow path for the second fluid 3, formed between the outer cylinder 12 and the intermediate cylinder 15. The sub flow path 124$a_2$ is a flow path for the second fluid 3, formed between the intermediate cylinder 15 and the inner cylinder 11.

When the second fluid 3 in a liquid phase is filled in the sub flow path 124$a_2$, the heat of the first fluid 2 transmitted to the inner cylinder 11 through the honeycomb structure 10 is transmitted to the second fluid 3 in the main flow path 124$a_1$ through the second fluid 3 in the sub flow path 124$a_2$. On the other hand, when the temperature of the inner cylinder 11 is higher and vapors (bubbles) of the second fluid 3 is generated in the sub flow path 124$a_2$, any heat conduction to the second fluid 3 in the main flow path 124$a_1$ through the second fluid 3 in the sub flow path 124$a_2$ is suppressed. This is because thermal conductivity of a fluid in a gas phase is lower than that of a liquid in a liquid phase. That is, in the heat exchanger 1 according to the present embodiment, a state where the heat exchange is efficiently performed and a state where heat exchange is suppressed are switched depending on whether or not the vapors of the second fluid 3 are generated in the sub flow path 124$a_2$. That state of heat exchange does not require any external control. As the second fluid 3, it is preferable to use a fluid having a boiling point in a temperature range where it is desired to suppress the heat exchange.

The height of the sub flow path 124$a_2$ is lower than the height of the main flow path 124$a_1$. It is preferable that the height of the main flow path 124$a_1$ is 0.15 mm or more and 30 mm or less, the height of the sub flow path 124$a_2$ is 0.05 mm or more and 3 mm or less, and a ratio of the height of the main flow path 124$a_1$ to the height of the sub flow path 124$a_2$ (=the height of the main flow path 124$a_1$/the height of the sub flow path 124$a_2$) is 1.6 or more and 10 or less.

If the height of the main flow path 124$a_1$ is less than 0.15 mm, a heat shielding property is decreased. That is, since the inflow of the second fluid 3 into the sub flow path 124$a_2$ is increased, it is difficult for the second fluid 3 in the gas phase to stay in the sub flow path 124$a_2$, so that the heat exchange cannot be effectively suppressed by the second fluid 3 in the gas phase. Further, the heights of the main flow path 124$a_1$ and the sub flow path 124$a_2$ become close to each other, which will tend to be affected by eccentricity or the like of the intermediate cylinder 15.

On the other hand, if the height of the main flow path 124$a_1$ is more than 30 mm, the heat recovery performance is lowered. That is, an amount of the second fluid 3 that is not subjected to the heat exchange is increased, so that the temperature of the second fluid 3 is hardly increased.

Further, if the height of the sub flow path 124$a_2$ is less than 0.05 mm, the heat shielding property is lowered. That is, if the inner cylinder 11 and the intermediate tube 15 are too close to each other, the heat of the inner cylinder 11 is transferred to the intermediate cylinder 15, so that the heat conduction cannot effectively suppressed by the second fluid 3 in the gas phase in the sub flow path 124$a_2$.

On the other hand, if the height of the sub flow path 124$a_2$ is more than 3 mm, the heat recovery performance is lowered. That is, if the space between the inner cylinder 11 and the intermediate cylinder 15 is too wide, the temperature of the second fluid 3 in the sub flow path 124$a_2$ is hardly increased, so than it is also difficult to increase the temperature of the second fluid 3 in the main flow path 124$a_1$.

The heat shielding performance on the vertical axis in FIG. 7 means a recovered heat quantity (kW) at a high load (700° C.-20 g/s). When the ratio of the height of the main flow path 124$a_1$ to the height of the sub flow path 124$a_2$ is 1.6, the recovered heat quantity at the high load can be reduced by about 30% as compared with a case where the sub flow path 124$a_2$ is not present. On the other hand, when the ratio of the height of the main flow path 124$a_1$ to the height of the sub flow path 124$a_2$ is less than 1.6, as shown in FIG. 7, the heat shielding performance approaches that of the case where the sub flow path 124$a_2$ is not present, so that the heat shielding performance is deteriorated. That is, since the inflow of the second fluid 3 into the sub flow path 124$a_2$ is increased, it is difficult for the second fluid 3 in the gas phase to stay in the sub flow path 124$a_2$, so that the heat exchange cannot be effectively suppressed by the second fluid 3 in the gas phase.

On the other hand, when the ratio of the height of the main flow path 124$a_1$ to the height of the sub flow path 124$a_2$ is more than 10, the heat recovery performance is deteriorated as shown in FIG. 7. That is, the amount of the second fluid 3 that is not subjected to the heat exchange is increased, so that the temperature of the second fluid 3 is hardly increased.

As particularly shown in FIGS. 2 and 6, between the end portion of the intermediate cylinder 15 and the inner cylinder 11 are opening portions 150 that are in communication with the sub flow path 124$a_2$. The opening portions 150 according to the present embodiment are provided on both an inlet side and an outlet side of the sub flow path 124$a_2$ in the flow direction of the second fluid 3. However, the opening portion 150 may be provided on only one of the inlet side and the outlet side of the sub flow path 124$a_2$ in the flow direction of the second fluid 3. As shown particularly in FIG. 2, in the present embodiment, four opening portions 150 are provided at the same interval in the circumferential direction of the honeycomb structure 10. However, the number of the opening portions 150 is arbitrary. Also, the intervals between the opening portions 150 may be different from each other.

The heat exchanger 1 according to the present embodiment is configured such that the second fluid 3 flows in and out of the sub flow path 124$a_2$ through the opening portions 150 between the end portion of the intermediate cylinder 15 and the inner cylinder 11. In other words, in the heat exchanger 1 according to the present embodiment, no opening portion is provided in the peripheral wall of the intermediate cylinder 15. However, the heat exchanger 1 may be configured such that the second fluid 3 flows in the sub flow path 124$a_2$ through the opening portion provided in the peripheral wall of the intermediate cylinder 15.

As particularly shown in FIG. 2, portions other than the opening portions 150 between the end portion of the intermediate cylinder 15 and the inner cylinder 11 are provided with wall bodies 151 each covering a space between the end portion of the intermediate cylinder 15 and the inner cylinder 11. The wall bodies 151 of the present embodiment are provided on both of the inlet side and the outlet side of the sub flow path 124$a_2$ in the flow direction of the second fluid 3. Further, each wall body 151 of the present embodiment is a solidified shapeless member such as a solidified molten metal attached to the intermediate cylinder 15, the inner cylinder 11 and the spacer 16 in order to fix the intermediate cylinder 15, the inner cylinder 11 and the spacer 16 to one another. However, each wall body 151 can be a plate portion that is different from the intermediate cylinder 15 and the inner cylinder 11 and is fixed to the intermediate cylinder 15 and the inner cylinder 11 by welding or the like. Further, each wall body 151 can be a plate portion integral with the intermediate cylinder 15 or the inner cylinder 11, such as a plate portion where the end portion of the intermediate cylinder 15 is bent.

It is preferable that an area of the opening portion 150 to the entire area between the end portion of the intermediate cylinder 15 and the inner cylinder 11 in the plane orthogonal to the axial direction 10$c$ of the honeycomb structure 10 is 1% or more and 50% or less.

If the area ratio is less than 1%, the heat recovery performance is lowered. That is, the inflow of the second fluid 3 into the sub flow path 124$a_2$ is decreased, and the second fluid 3 in the gas phase tends to be generated in the sub flow path 124$a_2$. Therefore, it tends to be in a state of suppressing the heat exchange, so that the temperature rise of the second fluid 3 in the main flow path 124$a_1$ is easily hindered.

On the other hand, if the area ratio is more than 50%, the heat shielding performance is deteriorated. That is, the inflow of the second fluid 3 into the sub flow path 124$a_2$ is increased, so that even if the second fluid 3 in the gas phase is generated in the sub flow path 124$a_2$, it is difficult for the fluid 3 in the gas phase to stay in the sub flow path 124$a_2$. Therefore, the heat exchange cannot be effectively suppressed by the second fluid 3 in the gas phase.

It is more preferable that the area of the opening portions 150 to the entire area between the end portion of the intermediate cylinder 15 and the inner cylinder 11 is 2% or more and 30% or less. This is because deterioration of the heat recovery performance and deterioration of the heat shielding performance can be more reliably avoided.

<Regarding Spacer>

The spacer 16 according to the present embodiment is configured to ensure a space between the intermediate cylinder 15 and the inner cylinder 11 and is provided between the intermediate cylinder 15 and the inner cylinder 11. The spacer 16 of the present embodiment is composed of a member different from the intermediate cylinder 15 and the inner cylinder 11. Both ends of the spacer 16 in the radial direction of the honeycomb structure 10 are brought into contact with the intermediate cylinder 15 and the inner cylinder 11, so that a space is ensured between the intermediate cylinder 15 and the inner cylinder 11. However, the spacer 16 may be integral with one of the intermediate cylinder 15 and the inner cylinder 11, such as a convex portion provided on the intermediate cylinder 15 or the inner cylinder 11, for example. When the spacer 16 is configured to be integral with one of the intermediate cylinder 15 and the inner cylinder 11, the tips of the spacer 16 in the radial direction of the honeycomb structure 10 are brought into contact with the others of the intermediate cylinder 15 and the inner cylinder 11, so that a space is ensured between the intermediate cylinder 15 and the inner cylinder 11.

It is preferable that the spacer 16 extends over the entire circumferential direction of the honeycomb structure 10. The spacer 16 may be formed by one member which continuously extends over the entire circumferential direction of the honeycomb structure 10 or may be formed by a plurality of members arranged adjacent to each other or spaced apart from each other in the circumferential direction of the honeycomb structure 10.

The spacer 16 according to the present embodiment includes first and second spacers 161, 162 which are spaced apart from each other in the axial direction 10$c$ of the honeycomb structure 10 and are provided between the intermediate cylinder 15 and the inner cylinder 11. In the present embodiment, the first spacer 161 is disposed on the first end face 10$a$ side of the honeycomb structure 10, and the second spacer 162 is disposed on the second end face 10$b$ side of the honeycomb structure 10.

The first and second spacers 161, 162 according to the present embodiment are disposed outside the first and second end faces 10$a$, 10$b$ of the honeycomb structure 10 in the axial direction 10$c$ of the honeycomb structure 10. In other words, when the first and second spacers 161, 162 are viewed along the radial direction of the honeycomb structure 10, the first and second spacers 161, 162 are arranged such that the first and second spacers 161, 162 do not overlap with the honeycomb structure 10, and further the second spacers 161, 162 do not contact the honeycomb structure 10. By disposing the first and second spacers 161, 162 at such positions, it can be difficult for the heat of the honeycomb structure 10 to be transmitted to the intermediate cylinder 15 through the first and second spacers 161, 162. When the heat of the honeycomb structure 10 is transmitted to the intermediate cylinder 15 through the first and second spacers 161, 162, the effect of suppressing the heat exchange by the second fluid 3 in the gas phase will be reduced.

It is preferable that the first and second spacers 161, 162 are disposed at positions spaced apart from the first and second end faces 10$a$, 10$b$ of the honeycomb structure 10 in the axial direction 10$c$ of the honeycomb structure 10 by a distance greater than 0 mm and 10 mm or less.

If the distance from the first and second end faces 10$a$, 10$b$ to the first and second spacers 161, 162 is 0 mm, the heat shielding performance is deteriorated. This is because the heat of the honeycomb structure 10 is transmitted to the intermediate cylinder 15 through the first and second spacers 161, 162.

On the other hand, if the distance from the first and second end faces 10$a$, 10$b$ to the first and second spacers 161, 162 is more than 10 mm, the dimensions of the heat exchanger 1 become unnecessarily large. This is because the effect of suppressing the heat conduction through the spacer 16 does not vary even if the distance of more than 10 mm is ensured.

Further, when the protruding portions 110 are provided on the inner peripheral surface of the inner cylinder 11 as in the heat exchanger 1 of the present embodiment, the first and second spacers 161, 162 are preferably arranged on an outer side than the protruding portions in the axial direction 10*c* of the honeycomb structure 10. Again, this is to prevent the heat of the honeycomb structure 10 from being transmitted to the first and second spacers 161, 162 through the protruding portions 110. It is preferable that the spaced distance between the protruding portion 110 and the first and second spacers 161, 162 in the axial direction 10*c* of the honeycomb structure 10 is greater than 0 mm and 10 mm or less.

The spacers 16 (the first and the second spacers 161, 162) of the present embodiment each has a three-dimensional structure which allows passage of the second fluid 3 in the liquid phase and inhibits passage of bubbles of the second fluid 3. Such a three-dimensional structure includes a mesh structure (a network structure) or a sponge-like structure (a porous structure). The phrase "the spacer 16 allows passage of the second fluid 3 in the liquid phase" means that the second fluid 3 can pass through the spacer 16, and the spacer 16 may be resistance to the passage of the second fluid 3. The phrase "the spacer 16 inhibits passage of bubbles of the second fluid 3" includes the meanings that the air bubbles of the second fluid 3 adhere to the spacer 16 and the spacer 16 will be resistance during the movement of the air bubbles of the second fluid 3. It is preferable that the spacer 16 has a mesh structure for the reason that it is easy to compatibly establish the liquid passage allowable property of the second fluid 3 and the bubble permeation inhibiting property of the second fluid 3.

The spacer 16 (the first and the second spacers 161, 162) according to the present embodiment is formed between the end portion of the intermediate cylinder 15 and the inner cylinder 11 such that the second fluid 3 which goes in and out the sub flow path 124$a_2$ through the opening portions 150 passes through the spacer 16.

When the major part in the sub flow path 124$a_2$ is filled with the second fluid 3 in the gas phase, the temporary flowing of a large amount of the second fluid 3 into the sub flow path 124$a_2$ results in rapid generation of boiling vaporization of the second fluid 3. Such rapid boiling vaporization of the second fluid 3 will cause vibrations and noises. The spacer 16 acts as resistance against the passage of the second fluid 3 in the liquid phase, so that the inflow of the second fluid 3 into the sub flow path 124$a_2$ becomes gentle, and generation of vibrations and noises can be suppressed.

The spacer 16 hinders the passage of the air bubbles of the second fluid 3, so that the second fluid 3 in the gas phase accumulates in the sub flow path 124$a_2$ and suppression of the heat exchange by the second fluid 3 in the gas phase is more reliably exerted. To suppress the heat exchange more reliably, a porosity of the spacer 16 is preferably 20% or more, and more preferably 40% or more, and even more preferably 60% or more. Further, the porosity of the spacer 16 is preferably 98% or less, and more preferably 95% or less, and even more preferably 90% or less. In the present invention, the porosity of the spacer 16 is measured by the following procedure:

(1) A true density of a material making up the spacer is obtained by the Archimedes method.

(2) A bulk density was determined from an apparent volume of the spacer calculated from outer dimensions (thickness, longitudinal and lateral lengths) of the spacer and the weight of the spacer.

(3) The porosity is calculated using the relational expression: porosity=(1−bulk density/true density)×100%.

<Regarding Cover>

The covers 17 according to the present embodiment are tubular bodies arranged on an upstream side and a downstream side of the honeycomb structure 10 in the flow direction of the first fluid 2. Each cover 17 is inserted into an inner side of the inner cylinder 11 and covers the inner cylinder 11 so as to prevent the flow of the first fluid 2 from being directly contacted with the inner cylinder 11.

It is preferable that a spaced distance between the end of each cover 17 and each of the first and second end faces 10*a*, 10*b* of the honeycomb structure 10 is 2 mm or more and 10 mm or less. The spaced distance is a distance along the axial direction 10*c* of the honeycomb structure 10.

If the spaced distance is less than 2 mm, the recovery performance of heat will be decreased. That is, the inflow of the first fluid 2 into the honeycomb structure 10 is limited by the covers 17, so that it is difficult to increase the temperature of the honeycomb structure 10.

On the other hand, if the spaced distance is more than 10 mm, the heat shielding performance will be deteriorated. That is, the direct contact of the flow of the first fluid 2 results in an increased temperature of the inner cylinder 11, so that the heat conduction cannot be effectively suppressed by the second fluid 3 in the gas phase in the sub flow path 124$a_2$.

A diameter (an inner diameter) of each cover 17 is preferably 0.6 times or more and 0.95 times or less a diameter (an outer diameter) of the honeycomb structure 10.

If the diameter of each cover 17 is less than 0.6 times the diameter of the honeycomb structure 10, the heat recovery performance will be deteriorated. The heat shielding performance will be deteriorated. That is, the inflow of the first fluid 2 into the honeycomb structure 10 is limited by the covers 17, so that it is difficult to increase the temperature of the honeycomb structure 10.

On the other hand, if the diameter of each cover 17 is more than 0.95 times the diameter of the honeycomb structure 10, the heat shielding performance will be deteriorated. That is, the temperature of the inner cylinder 11 is increased by transmission of the heat of the cover 17, so that the heat conduction cannot be effectively suppressed by the second fluid 3 in the gas phase in the sub flow path 124$a_2$.

Each cover 17 is supported by a cone 170. The cone 170 is a tubular member disposed outside the cover 17 in the radial direction of the cover 17. The cone 170 according to the present embodiment has a peripheral wall having a cross section in a crank shape. One end 170*a* of the cone 170 is positioned radially outward of the cone 170 and the other end 170*b* of the cone 170 is positioned radially inward of the cone 170. Each cover 17 is fixed to the other end 170*b* by welding or the like while being brought into surface contact with the other end 170*b* of the cone 170.

One end 170*a* of the cone 170 according to the present embodiment is fixed to the outer cylinder 12. More particularly, one end 170*a* of the cone 170 is in contact with an end wall 123 of the outer cylinder 12, and is fixed to the end wall 123 by a method such as welding. One end 170*a* of the cone 170 is fixed to a radially outer side of the outer cylinder 12 so as to be away from the inner cylinder 11. It is understood that the radially outer side of the outer cylinder 12 is a position closer to the expanded diameter peripheral wall 121 than the central position of the end wall 123 in the radial direction of the cone 170. If one end 170*a* of the cone 170 is fixed to the end portion of the inner cylinder 11, the cone 170 suppresses the expansion of the inner cylinder 11 when reaching an elevated temperature of the inner cylinder 11, so that the inner cylinder 11 may be bent. The bending of the inner cylinder 11 may generate positional deviation in each portion and deteriorate the performance of the heat exchanger 1. To suppress such deterioration of the performance, as described above, one end 170*a* of the cone 170 is preferably fixed to the outer cylinder 12, more preferably, it is fixed to the radially outer side of the outer cylinder 12.

Next, FIG. 8 is an explanatory view showing the intermediate cylinder 15 in FIG. 1 in more detail. The intermediate cylinder 15 according to the present embodiment is formed by winding a plate member in a cylindrical shape so as to sandwich the spacer 16 between the intermediate cylinder 15 and the inner cylinder 11. The plate member is wound and tightened so as to press the spacer 16 against the inner cylinder 11 to restrict the displacement of the spacer 16.

As shown in FIG. 8, the intermediate cylinder 15 includes first and second side portions 152, 153 which are the plate members forming the intermediate cylinder 15. The first side portion 152 is one side portion in the width direction of the plate member, and the second side portion 153 is the other side portion in the width direction of the plate member. As shown in FIG. 8, when the plate member is wound into a cylindrical shape, the width direction of the plate member has the same meaning as the circumferential direction of the intermediate cylinder 15. The first and second side portions 152, 153 extend in the axial direction 10*c* of the honeycomb structure 10.

The second side portion 153 according to the present embodiment is overlaid on the first side portion 152 and positioned radially outward of the intermediate cylinder 15. As shown in FIG. 8, the second side portion 153 is preferably bent in a crank shape along the outer surface of the first side portion 152. Since the second side portion 153 is along the outer surface of the first side portion 152, it is possible to avoid the generation of a gap between the first and second side portions 152, 153. The gap between the first and second side portions 152, 153 is not preferable because it inhibits the flowing of the second fluid 3 in the main flow path 124$a_1$.

In the heat exchanger 1 according to the present embodiment, the height of the intermediate flow path 124*a* is lower than the heights of the supply-side side flow path 124*b* and the discharge-side side flow path 124*c*, so that the second fluid 3 can be thoroughly distributed in the supply-side side flow path 124*b* and the discharge-side side flow path 124*c* in the circumferential direction of the honeycomb structure 10 and the second fluid 3 which is not subjected to the heat exchange in the intermediate flow path 124*a* can be reduced, thereby enabling the heat exchange efficiency to be improved. The configuration is particularly useful for improving the heat exchange efficiency (the heat recovery efficiency) at a lower load in which the temperature of the honeycomb structure 10 is low.

Further, in the heat exchanger 1 according to the present embodiment, the second fluid 3 flows in parallel with the first fluid 2, so that the second fluid 3 which is not subjected to the heat exchange in the intermediate flow path 124*a* can be decreased and the heat exchange efficiency can be improved. Furthermore, the warmed second fluid 3 can be discharged in a shorter period of time and the heat collection efficiency can be improved.

Further, in the heat exchanger 1 according to the present embodiment, the supply-side side flow path 124*b* is disposed on the downstream side of the discharge-side side flow path 124*c* in the flow direction of the first fluid 2, so that the second fluid 3 can be reversed against the first fluid 2 in the intermediate flow path 124*a*, and as the second fluid 3 moves in the axial direction 10*c*, the second fluid 3 exchanges heat to the first fluid 2 having a higher temperature (the inner cylinder 11), thereby enabling the heat exchange efficiency to be improved.

Furthermore, in the heat exchanger 1 according to the present embodiment, the height of the main flow path 124$a_1$ is 0.15 mm or more and 30 mm or less, the height of the sub flow path 124$a_2$ is 0.05 mm or more and 3 mm or less, and the ratio of the height of the main flow path 124$a_1$ to the height of the sub flow path 124$a_2$ is 1.6 or more and 10 or less, so that both of the heat shielding performance and the heat recovery performance can be more reliably achieved.

Further, in the heat exchanger 1 according to the present embodiment, at least one opening portion 150 that is in communication with the sub flow path 124$a_2$ is provided between the end portion of the intermediate cylinder 15 and the inner cylinder 11, so that vapors (air bubbles) of the second fluid 3 generated in the sub flow path 124$a_2$ can be easily reserved in the sub flow path 124$a_2$. This can allow an increase in a vapor layer of the second fluid 3 in the sub flow path 124$a_2$, thereby improving the heat shielding performance.

Furthermore, in the heat exchanger 1 according to the present embodiment, the area of the opening portion 150 to the entire area between the end of the intermediate cylinder 15 and the inner cylinder 11 in the plane orthogonal to the axial direction 10*c* of the honeycomb structure 10 is 1% or more and 50% or less, so that both of the heat recovery performance and the heat shielding performance can be more reliably achieved.

Moreover, in the heat exchanger 1 according to the present embodiment, the spacer 16 is disposed outside the first and second end faces 10*a*, 10*b* of the honeycomb structure 10 in the axial direction 10*c* of the honeycomb structure 10, so that the heat of the honeycomb structure 10 can be prevented from being transmitted to the intermediate cylinder 15 through the spacer 16, thereby enabling the heat shielding performance to be improved.

Further, in the heat exchanger 1 according to the present embodiment, the spacer 16 is disposed at a position that is spaced apart from the end face of the honeycomb structure by a distance of more than 0 mm and not more than 10 mm in the axial direction 10*c* of the honeycomb structure 10, so that the deterioration of the heat shielding performance can be prevented and an unnecessarily increase in the size of the heat exchanger 1 can be avoided.

Furthermore, the spacer 16 has a three-dimensional structure that allows passage of the second fluid 3 in the liquid phase and inhibits passage of air bubbles of the second fluid 3, so that the inflow of the second fluid 3 can be gentle, thereby suppressing generation of vibrations and noises. In addition, the second fluid 3 in the vapor phase can be easily reserved in the sub flow path 124$a_2$, and the suppression of the heat exchange by the second fluid 3 in the vapor phase can be more reliably exerted.

Embodiment 2

FIG. 9 is a cross-sectional view of a heat exchanger 1 according to Embodiment 2 of the present invention. The embodiment 1 has been described such that the supply-side side flow path 124*b* is disposed on the downstream side of the discharge-side side flow path 124*c* in the flow direction of the first fluid 2. However, as shown in FIG. 9, in the heat exchanger 1 according to Embodiment 2, the supply-side side flow path 124*b* is disposed on an upstream side of the discharge-side side flow path 124*c* in the flow direction of the first fluid 2. Other configurations are the same as those in Embodiment 1.

As in the Embodiment 2, the supply-side side flow path 124*b* may be disposed on the upstream side of the discharge-side side flow path 124*c* in the flow direction of the first fluid 2.

Embodiment 3

FIG. 10 is an explanatory view showing a relationship between the inner cylinder 11/the intermediate cylinder 15 and the spacer 16 in the heat exchanger 1 according to Embodiment 3 of the present invention. The intermediate cylinder 15 according to Embodiment 3 is formed through steps as shown in FIGS. 10(*a*) and 10(*c*).

In the step shown in FIG. 10(*a*), the first and second spacers 161 and 162 are arranged on the outer peripheral surface of the inner cylinder 11. The first spacer 161 is fixed to the inner cylinder 11 by a fixing portion 161*a*. The fixing portion 161*a* can be formed by welding. In the step shown in FIG. 10(*a*), the second spacer 162 is not fixed.

In the step shown in FIG. 10(*b*), the intermediate cylinder 15 is formed by winding the plate member in a cylindrical shape so as to sandwich the first and second spacers 161, 162 between the intermediate cylinder 15 and the inner cylinder 11. A wall body 151 is also formed so as to be in contact with the inner cylinder 11, the second spacer 162, and the intermediate cylinder 15. The wall body 151 of Embodiment 3 is formed by solidifying a molten metal attached to the intermediate cylinder 15 and the inner cylinder 11 in order to fix the intermediate cylinder 15 and the inner cylinder 11 to each other. The inner cylinder 11, the second spacer 162 and the intermediate cylinder 15 are fixed to one another via the wall body 151. On the other hand, the first spacer 161 is not fixed (in a non-fixed state) to the intermediate cylinder 15. That is, in Embodiment 3, the second spacer 162 is fixed to both the intermediate cylinder 15 and the inner cylinder 11, whereas the first spacer 161 is fixed to the inner cylinder 11 and is not fixed to the intermediate cylinder 15. Conversely, the first spacer 161 may be fixed to both the intermediate cylinder 15 and the inner cylinder 11, whereas the second spacer 162 may be fixed to the inner cylinder 11 and may not be fixed to the intermediate cylinder 15. Other configurations are the same as those in Embodiments 1 and 2.

If both of the first and second spacers 161, 162 are fixed to both of the intermediate cylinder 15 and the inner cylinder 11, respectively, the following phenomenon may occur. That is, when the vapors (air bubbles) of the second fluid 3 is generated in the sub flow path 124$a_2$ and the heat exchange between the second fluid 3 in the sub flow path 124$a_2$ and the second fluid 3 in the main flow path 124$a_1$ is suppressed, a temperature difference is generated between the inner cylinder 11 and the intermediate cylinder 15. In this case, the inner cylinder 11 is heated by the heat of the first fluid 2, while the intermediate cylinder 15 is cooled by the second fluid 3 in the main flow path 124$a_1$, so that the inner cylinder 11 expands more than the intermediate cylinder 15. When both of the first and second spacers 161, 162 are fixed to both of the intermediate cylinder 15 and the inner cylinder 11, respectively, the fixing portions of the first and second spacers 161, 162 are broken due to stress caused by a difference in expansion between the intermediate cylinder 15 and the inner cylinder 11 to deviate the positional relationship between the intermediate cylinder 15 and the inner cylinder 11, so that the sub flow path 124$a_2$ is lost.

As in Embodiment 3, the second spacer 162 is fixed to both of the intermediate cylinder 15 and the inner cylinder 11, while the first spacer 161 is fixed to the inner cylinder 11 and is not fixed to the intermediate cylinder 15, thereby enabling prevention of the phenomenon that the fixing portions of the first and second spacers 161, 162 are broken due to the stress caused by the difference in expansion between the intermediate cylinder 15 and the inner cylinder 11 to deviate he positional relationship between the intermediate cylinder 15 and the inner cylinder 11 and the sub flow path 124$a_2$ is lost.

Embodiment 4

FIG. 11 is a cross-sectional view of a heat exchanger 1 according to Embodiment 4 of the present invention. The Embodiment 1 has been described such that that one end 170*a* of the cone 170 is in contact with the end wall 123 of the outer cylinder 12 and is fixed (see FIG. 1). In the case of such a fixing method, stress concentrates on the fixing portion between the cone 170 and the outer cylinder 12, so that the fixing portion may be damaged. The heat exchanger 1 according to Embodiment 4 is configured so as to be able to reduce the possibility of damage of the fixing portion between the cone 170 and the outer cylinder 12.

As shown in FIG. 11, a straight peripheral wall 123*a* and a connecting peripheral wall 123*b* are provided on a side of an expanded diameter peripheral wall 121 of an outer cylinder 12 according to Embodiment 4. The straight peripheral wall 123*a* according to the present embodiment is a peripheral wall which is disposed at a position spaced apart from the expanded diameter peripheral wall 121 in the axial direction of the outer cylinder 12 (in the axial direction 10*c* of the honeycomb structure 10), and which linearly extends along the extending direction of the outer peripheral surface of the inner cylinder 11. The inner peripheral surface of the straight peripheral wall 123*a* according to the present embodiment is in contact with the outer peripheral surface of the inner cylinder 11. An inner diameter of the straight peripheral wall 123*a* is smaller than an inner diameter of the central peripheral wall 120. The straight peripheral wall 123*a* forms an end portion of the outer cylinder 12. The connecting peripheral wall 123*b* is a peripheral wall connecting the expanded diameter peripheral wall 121 and the straight peripheral wall 123*a*. The connecting peripheral wall 123*b* according to Embodiment 4 extends obliquely with respect to the axial direction of the outer cylinder 12 and an inner diameter of the connecting peripheral wall 123*b* is gradually reduced from the expanded diameter peripheral wall 121 toward the straight peripheral wall 123*a*. However, the connecting peripheral wall 123*b* may extend along the plane orthogonal to the axial direction of the outer cylinder 12.

The outer cylinder 12 according to Embodiment 4 has a shape that is symmetrical using the center position in the axial direction of the outer cylinder 12 as a center. That is, the shapes and inner diameters of the straight peripheral wall 123*a* and the connecting peripheral wall 123*b* on one end side in the axial direction of the outer cylinder 12 are the same as the shapes and inner diameters of the straight peripheral wall 123*a* and the connecting peripheral wall 123*b* on the other end side in the axial direction of the outer cylinder 12.

One end 170*a* of a cone 170 according Embodiment 4 linearly extends along the extending direction of the outer peripheral surface of the straight peripheral wall 123*a*. An inner peripheral surface of one end 170*a* of the cone 170 is in contact with an outer peripheral surface of the straight peripheral wall 123*a*. That is, one end 170*a* of the cone 170 is in surface contact with the end portion (the straight peripheral wall 123*a*) of the outer cylinder 12. In such a state, one end 170*a* of the cone 170 is fixed to the straight peripheral wall 123*a* (the outer cylinder 12). Other configurations are the same as those in Embodiments 1-3.

In the heat exchanger 1 according to Embodiment 4, one end of the cone 170 extends along the extending direction of the outer peripheral surface of the end portion (the straight peripheral wall 123*a*) of the outer cylinder 12 and is fixed to the end portion of the outer cylinder 12 while being in surface contact with the end portion of the outer cylinder 12, so that the fixing region between the cone 170 and the outer cylinder 12 can be expanded as compared with Embodiment 1 where one end of the cone 170 is fixed while abutting against the outer cylinder 12. This can allow the possibility of breakage of the fixing portion between the cone 170 and the outer cylinder 12 to be decreased.

Embodiment 5

FIG. 12 is a cross-sectional view of a heat exchanger 1 according to Embodiment 5 of the present invention. The Embodiment 4 has been described such that the shapes and inner diameters of the straight peripheral wall 123*a* and the connecting peripheral wall 123*b* on the one end side in the axial direction of the outer cylinder 12 are the same as the shapes and inner diameters of the straight peripheral wall 123*a* on the other end side in the axial direction of the outer cylinder 12 and the connecting peripheral wall 123*b*. With such a configuration, it is difficult to assemble the outer cylinder 12 to a heat exchanger element body formed by integrating the honeycomb structure 10, the inner cylinder 11 and the intermediate cylinder 15. The heat exchanger 1 according to Embodiment 5 is configured such that the heat exchanger element body and the outer cylinder 12 can be more easily assembled than the heat exchanger 1 according to Embodiment 4.

As shown in FIG. 12, the shape of the outer cylinder 12 according to Embodiment 5 is asymmetric using the center position in the axial direction of the outer cylinder 12 as a center. That is, the inner diameter of the outer cylinder 12 on one end side in the axial direction is larger than the inner diameter of the outer cylinder 12 on the other end side in the axial direction. More particularly, the inner diameter of the straight peripheral wall 123*a* (123$a_1$) on one end side in the axial direction of the outer cylinder 12 is larger than the inner diameter of the linear peripheral wall 123*a* (123$a_2$) on the other end side in the axial direction of the outer cylinder 12. The inner peripheral diameter of the straight peripheral wall 123*a* (123$a_1$) on one end side is larger than the outer diameter of the intermediate cylinder 15. An annular cap member 18 is fitted between the straight peripheral wall 123*a* (123$a_1$) on one end side and the inner cylinder 11. The straight peripheral wall 123*a* on one end side is fixed to the inner cylinder 11 by welding or the like via the annular cap member 18. Other configurations are the same as those in Embodiments 1-4.

In the heat exchanger 1 according to Embodiment 5, the inner diameter of the outer cylinder 12 on one end side in the axial direction is larger than the inner diameter of the outer cylinder 12 on the other end side in the axial direction, so that the heat exchanger element body and the outer cylinder 12 can be more easily assembled.

Embodiment 6

FIG. 13 is a cross-sectional view of a heat exchanger 1 according to Embodiment 6 of the present invention. The Embodiment 5 has been described such that the inner diameter of the outer cylinder 12 on one end side in the axial direction is larger than the inner diameter of the outer cylinder 12 on the other end side in the axial direction, and the annular cap member 18 is fitted between the one end side and the inner cylinder 11. With such a configuration, the number of parts is increased by the addition of the cap member 18. The heat exchanger 1 according to Embodiment 6 is configured to reduce the number of parts, as compared with the heat exchanger 1 according to Embodiment 5.

As shown in FIG. 13, one end of the inner cylinder 11 according to Embodiment 6 is provided with an enlarged diameter portion 11*a*. An outer diameter of the enlarged diameter portion 11*a* is equal to an inner diameter of the straight peripheral wall 123*a* (123*a*1) on one end side in the axial direction of the outer cylinder 12. That is, the outer peripheral surface of the enlarged diameter portion 11*a* is in contact with the inner peripheral surface of the straight peripheral wall 123*a* on the one end side. The enlarged diameter portion 11*a* is fixed to the straight peripheral wall 123*a* on one end side by welding or the like. Other configurations are the same as those in Embodiments 1-5.

Next, FIG. 14 is a cross-sectional view for explaining the production method of the heat exchanger 1 in FIG. 13. The cross-sectional view is a sectional view in a direction parallel to the first flow path of the honeycomb structure 10.

First, an element 60 in which the honeycomb structure 10 is fitted into the inner cylinder 11 is prepared, as shown in FIG. 14(*a*).

Then, as shown in FIG. 14(*b*), a spacer 16 is arranged on an outer periphery of an inner cylinder 11, and an intermediate cylinder 15 is arranged on the outer periphery of the spacer 16. It is preferable that the fixing of the spacer 16 uses the manner as described in Embodiment 3. Further, it is preferable that the side end portion of the plate member forming the intermediate cylinder 15 is processed as shown in FIG. 8.

Then, as shown in FIG. 14(*c*), after disposing the outer cylinder 12 on the outer peripheries of the inner cylinder 11 and the intermediate cylinder 15, the outer cylinder 12 is fixed to the inner cylinder 11 at both side ends of the outer cylinder 12 in the axial direction by welding or the like. An inner diameter of the outer cylinder 12 on one end side in the axial direction corresponds to the enlarged diameter portion 11*a* of the inner cylinder 11 and an inner diameter of the outer cylinder 12 on the other end side corresponds to an outer diameter of a small diameter portion of the inner cylinder 11. Therefore, it can be difficult for the direction of insertion of the element 60 or the like into the outer cylinder 12 to be wrong.

Then, as shown in FIG. 14(*d*), cones 170 are fitted to both side ends of the outer cylinder 12 and fixed by welding or the like.

In the heat exchanger 1 according to Embodiment 6, the enlarged diameter portion 11*a* with a diameter enlarged so as to be in contact with one end side of the outer cylinder 12 in the axial direction is provided at one end of the inner cylinder 11, so that any cap member 18 according to Embodiment 5 cannot be required and the number of parts can be reduced. Further, the enlarged diameter portion 11*a* is provided at a position that is not in contact with the honeycomb structure 10, so that an expansion margin of the inner cylinder 11 can be ensured when reaching an elevated temperature of the inner cylinder 11. The expansion of the inner cylinder 11 is escaped by the expansion margin of the inner cylinder 11 when reaching the elevated temperature of the inner cylinder 11, so that it is possible to suppress a decrease in the heat recovery efficiency of the heat exchanger 1 at the elevated temperature due to the distortion of the inner cylinder 11. Further, the enlarged diameter portion 11*a* is provided at one end of the inner cylinder 11, so that it is difficult for errors of the positions and the insertion directions of the members to be formed to occur, and it is easy to assemble the members, and it is thus easy to be produced.

Embodiment 7

FIG. 15 is a cross-sectional view showing a main part of a heat exchanger 1 according to Embodiment 7 of the present invention, and FIG. 16 is a sectional view showing a variation of the main part of the heat exchanger 1 in FIG. 7. In the heat exchanger 1 according to the present embodiment, at least one turbulent flow generating portion 7 is provided in at least one of the inner cylinder 11, the outer cylinder 12 and the intermediate cylinder 15. The turbulent flow generating portion 7 is a portion for generating a turbulent flow in the second fluid 3 passing through the second flow path 124. By generating the turbulent flow in the second fluid 3 passing through the second flow path 124, the second fluid 3 is agitated in the second flow path 124. Thus, the heat transfer coefficient between the first fluid and the second fluid is improved, so that the heat exchange efficiency between the first fluid 2 and the second fluid 3 can be improved.

FIG. 15(*a*) to (*d*) show modes where the turbulent flow generating portion 7 is provided at the outer cylinder 12. As shown in FIG. 15(*a*), the turbulent flow generating portion 7 can be a reduced diameter portion in which a diameter of a part of the outer cylinder 12 is reduced. As shown in FIG. 15(*b*), the outer cylinder 12 may be provided with a plurality of turbulent flow generating portions 7 composed of reduced diameter portions. The shape of the turbulent flow generating portion 7 is not particularly limited as long as it is a shape capable of generating a turbulent flow. For example, the turbulent flow generating portion 7 may be formed by a projected portion as shown in FIG. 15(*c*), or the turbulent flow generating portion 7 may be formed by a recessed portion as shown in FIG. 15(*d*).

FIG. 16(*a*) shows a mode where a plurality of turbulent flow generating portions 7 each comprised of an enlarged diameter portion with a part of the intermediate cylinder 15 enlarged are provided at the intermediate cylinder 15. As shown in FIG. 16(*a*), when the turbulent flow generating portions 7 each composed of the expanded diameter portion where a part of a wall surface of the intermediate cylinder 15 is allowed to protrude toward the inside of the main flow path 124$a_1$ are provided, the enlarged diameter portions also serve as the turbulent flow generating portions 7 each comprised of the recessed portion in the flow path 124$a_2$. Any combination of the inner cylinder 11, the outer cylinder 12, and the intermediate cylinder 15 provided with the turbulent flow generating portions 7 is possible. For example, the inner cylinder 11 and the outer cylinder 12 may be provided with the turbine flow generating portions 7 as shown in FIG. 16(*b*), or the outer cylinder 12 and the intermediate cylinder 15 may be provided with the turbine flow generating portions 7 as shown in FIG. 16(*c*), or the inner cylinder 11, the outer cylinder 12 and the intermediate cylinder may be provided with the turbulent flow generating portions 7 as shown in FIG. 16(*d*). As shown in FIG. 16(*d*), the turbulent flow generating portions 7 having different forms may be combined.

Any arrangement of the turbulent flow generating portions 7 in the circumferential direction and the axial direction of the honeycomb structure 10 is possible. In terms of increasing the effect of the turbulent flow, the turbulent flow generating portions 7 are preferably arranged on the upstream side of the second flow path 124 in the flow direction of the second fluid 3. One turbulent flow generating portion 7 may be provided continuously in the circumferential direction of the honeycomb structure 10 or a plurality of turbulent flow generating portions 7 may be spaced apart from each other in the circumferential direction of the honeycomb structure 10. Further, the turbulent flow generating portion 7 may be arranged in a spiral shape. Other configurations are the same as those in Embodiments 1-6.

In the heat exchanger 1 according to Embodiment 7, at least one of the inner cylinder 11, the outer cylinder 12 and the intermediate cylinder 15 includes at least one turbulent flow generating portion 7 for generating the turbulent flow in the second fluid 3 passing through the second flow path 124, so that the heat exchange efficiency between the first fluid 2 and the second fluid 3 can be improved.

Embodiment 8

FIG. 17 is a cross-sectional view of a heat exchanger 1 according to Embodiment 8 of the present invention. The heat exchangers according to Embodiments 1-7 of the present invention are required to be connected to a purification apparatus via a pipe in order to obtain a purification function, so that it is difficult to ensure a space for arrangement. Therefore, in the heat exchanger according to Embodiment 8 of the present invention, as shown in FIG. 17, a purifier 80 disposed on the upstream side of the honeycomb structure 10 in the flow direction of the first fluid 2 is supported by a frame 81 integrated with the outer cylinder 12, so that the purifier 81 is integrated with a heat exchange member 82 including the honeycomb structure 10, the inner cylinder 11, the outer cylinder 12 and the intermediate cylinder 15. This configuration can allow necessity of connecting the heat exchange member 82 to the purifier 80 via the pipe to be eliminated, thereby saving the space.

The frame 81 is a member integrated with the outer cylinder 12 by, for example, welding or the like. The frame 81 may be added to the configurations of Embodiments 1-7 or it may be formed by modifying the cones 170 in Embodiments 1-7.

The purifier 80 is a member for purifying the first fluid 2 before being introduced into the honeycomb structure 10. The purifier 80 is not particularly limited, and any known purification means in the art may be used. Examples of the purifier 80 include a catalyst body supporting a catalyst, a filter and the like. Examples of the catalyst that can be used when exhaust gas is used as the first fluid 2 include a catalyst having a function of oxidizing or reducing an exhaust gas. The catalyst includes noble metals such as platinum, rhodium, palladium, ruthenium, indium, silver and gold; aluminum, nickel, zirconium, titanium, cerium, cobalt, manganese, zinc, copper, tin, iron, niobium, magnesium, lanthanum, samarium, bismuth, barium and the like. These elements may be metal simple substances, metal oxides, and other metal compounds. Further, the catalyst may be used alone or two or more catalysts may be used. Other configurations are the same as those in the Embodiments 1-7.

In the heat exchanger 1 according to Embodiment 8, the purifier 80 disposed on the upstream side of the honeycomb structure 10 into the flow direction of the first fluid 2 is supported by the frame 81 provided integrally with the outer cylinder 12, so that it is possible to eliminate the necessity of connecting the heat exchanging member 82 and the purifying means 80 by piping and it is possible to save the space.

Embodiment 9

FIG. 18 is a cross-sectional view of a heat exchanger 1 according to Embodiment 9 of the present invention. The Embodiment 8 has been described such that the purifier 80 is disposed on the upstream side of the heat exchange member 82 in the flow direction of the first fluid 2. However, as shown in FIG. 18, the heat exchange member 82 may be disposed on the upstream side of the purifier 80 in the flow direction of the first fluid 2. Other configurations are the same as those in Embodiments 1-8.

In the heat exchanger 1 according to Embodiment 9, the heat exchange member 82 is disposed on the upstream side of the purifier 80 in the flow direction of the first fluid 2, thereby allowing the heat exchange between the first fluid 2 having a higher temperature before removing the heat by the purifier 80 and the second fluid 3, and enabling the heat exchange efficiency to be improved.

Embodiment 10

FIG. 19 is a cross-sectional view of a heat exchanger 1 according to Embodiment 10 of the present invention. When the heat exchange member 82 is arranged on the upstream side of the purifier 80 as in Embodiment 9 (FIG. 18), the heat exchange efficiency can be improved, while the temperature of the first fluid 2 when passing through the purifier 80 is decreased. If the temperature of the first fluid 2 is decreased, the purification performance of the first fluid 2 in the purifier 80 may be deteriorated. In the heat exchanger 1 according to Embodiment 10, as shown in FIG. 19, the purifier 80 according to Embodiment 9 is divided into first and second purifying bodies 80*a*, 80*b*, and between these first and second purifying bodies 80*a*, 80*b*, the heat exchange member 82 is disposed. Each length of the first and second purifying bodies 80*a*, 80*b* in the flow direction of the first fluid 2 are shorter than the length of the purifier 80 according to Embodiment 9 in the same direction. More particularly, each length the first and second purification bodies 80*a*, 80*b* is half of the purifier 80 according to Embodiment 9. However, the respective lengths of the first and second purified bodies 80*a*, 80*b* may be different from each other. Other configurations are the same as those in Embodiments 1-9.

In the heat exchanger 1 according to Embodiment 10, the heat exchange member 82 is disposed between the first and second purified bodies 80*a*, 80*b*, so that it is possible to achieve both of improvement of the heat exchange efficiency and the purification performance of the first fluid 2.

Embodiment 11

FIG. 20 is a cross-sectional view of a heat exchanger 1 according to Embodiment 11 of the present invention. The Embodiments 8-10 have been described such that one heat exchange member 82 is integrated with one or more purifiers 80. However, as shown in FIG. 20, the two heat exchange members 82 may be integrated with one or more purifiers 80. In FIG. 20, the heat exchange members 82 are disposed on both of the upstream side and the downstream side of the purifier 80 in the flow direction of the first fluid 2. However, two heat exchange members 82 may be disposed on the upstream side of the purifier 80, and two heat exchange members 82 may be disposed on the downstream side of the purifier 80. Three or more honeycomb structures 10 (the heat exchange members 82) may be integrated with one or more purifiers 80. Other configurations are the same as those in Embodiments 1-10.

In the heat exchanger 1 according to Embodiment 11, the plurality of heat exchange members 82 are integrated with one or more purifiers 80, so that the heat exchange efficiency can be further improved.

DESCRIPTION OF REFERENCE NUMERALS

1 heat exchanger
10 honeycomb structure
11 inner cylinder
12 outer cylinder
124 second flow path
124*a* intermediate flow path
124$a_1$ main flow path
124$a_2$ sub flow path
124*b* supply-side side flow path
124*c* discharge-side side flow path
13 supply pipe
14 discharge pipe
15 intermediate cylinder
16 spacer
161 first spacer
162 second spacer
2 first fluid
3 second fluid
7 turbulence generating portion
80 purifier
81 frame

What is claimed is:

1. A heat exchanger comprising:

a honeycomb structure having a plurality of cells, the cells providing first flow paths through which a first fluid is passed;

an inner cylinder attached to an outer periphery of the honeycomb structure; and an outer cylinder disposed on an outer periphery of the inner cylinder, the outer cylinder providing a second flow path through which a second fluid is passed, the second flow path being arranged between the outer cylinder and the inner cylinder, wherein the second flow path comprises:

an intermediate flow path extending in an axial direction of the honeycomb structure so as to include an outer peripheral position of the honeycomb structure; and side flow paths located on both sides of the intermediate flow path in the axial direction, and wherein the intermediate flow path has a height lower than that of each of the side flow paths.

2. The heat exchanger according to claim 1, wherein the second fluid flows in parallel to the first fluid.

3. The heat exchanger according to claim 1, wherein the side flow paths comprise:

a supply-side side flow path connected to a supply pipe that supplies the second fluid to the second flow path; and a discharge-side side flow path connected to a discharge pipe that discharges the second fluid from the second flow path, and wherein the supply-side side flow path is disposed on a downstream side of the discharge-side side flow path in a flow direction of the first fluid.

4. The heat exchanger according to claim 1, wherein each of the side flow paths comprises:

a supply-side side flow path connected to a supply pipe that supplies the second fluid to the second flow path; and a discharge-side side flow path connected to a discharge pipe that discharges the second fluid from the second flow path, and wherein the supply-side side flow path is disposed on an upstream side of the discharge-side side flow path in a flow direction of the first fluid.

5. The heat exchanger according to claim 1, wherein the intermediate flow path has a height of 0.2 mm or more and 33 mm or less.

6. The heat exchanger according to claim 1, wherein a height of each side flow path is 1.1 times or more that of the intermediate flow path.

7. The heat exchanger according to claim 1, further comprising an intermediate cylinder disposed between the inner cylinder and the outer cylinder on an outer periphery of the honeycomb structure, wherein the intermediate flow path comprises:

a main flow path arranged between the outer cylinder and the intermediate cylinder; and a sub flow path arranged between the intermediate cylinder and the inner cylinder, wherein the main flow path has a height of 0.15 mm or more and 30 mm or less, wherein the sub flow path has a height of 0.05 mm or more and 3 mm or less, and wherein a ratio of the height of the main flow path to the height of the sub flow path is 1.6 or more and 10 or less.

8. The heat exchanger according to claim 7, wherein at least one opening that is in communication with the sub flow path is provided between at least one end portion of the intermediate cylinder and the inner cylinder.

9. The heat exchanger according to claim 8, wherein an area of the at least one opening to the entire area between the at least one end portion of the intermediate cylinder and the inner cylinder in a plane orthogonal to the axial direction is 1% or more and 50% or less.

10. The heat exchanger according to claim 7, further comprising at least one spacer provided between the intermediate cylinder and the inner cylinder, wherein the at least one spacer is disposed outside at least one end face of the honeycomb structure in the axial direction.

11. The heat exchanger according to claim 10, wherein the at least one spacer is disposed at a position that is separated by a distance of more than 0 mm and not more than 10 mm from the end face of the honeycomb structure in the axial direction.

12. The heat exchanger according to claim 7, further comprising a spacer provided between the intermediate cylinder and the inner cylinder, wherein the spacer comprises first and second spacers disposed to be spaced apart from each other in the axial direction, and wherein one of the first and second spacers is fixed to both of the intermediate cylinder and the inner cylinder, and the other of the first and second spacers is fixed to the inner cylinder and is not fixed to the intermediate cylinder.

13. The heat exchanger according to claim 10, wherein the spacer has a three-dimensional structure that allows passage of the second fluid in a liquid phase and inhibits passage of bubbles of the second fluid.

14. The heat exchanger according to claim 7, wherein the intermediate cylinder comprises at least one turbulent flow generating portion for generating a turbulent flow in the second fluid passing through the second flow path.

15. The heat exchanger according to claim 1, wherein the inner cylinder and/or the outer cylinder comprises at least one turbulent flow generating portion for generating a turbulent flow in the second fluid passing through the second flow path.

16. The heat exchanger according to claim 1, further comprising:

a frame provided integrally with the outer cylinder; and at least one purifier disposed on at least one of an upstream side and a downstream side of the honeycomb structure in a flow direction of the first fluid.

17. The heat exchanger according to claim 16, wherein the frame integrates a plurality of heat exchange members each comprising the honeycomb structure, the inner cylinder and the outer cylinder with the at least one purifier.

18. The heat exchanger according to claim 1, wherein the honeycomb structure has a plurality of first partition walls and a plurality of second partition walls which form the plurality of cells, wherein the plurality of first partition walls are spaced apart from each other in a circumferential direction of the honeycomb structure and extend in a radial direction of the honeycomb structure, and wherein the plurality of second partition walls are spaced apart from each other in the radial direction of the honeycomb structure and extend in the circumferential direction of the honeycomb structure, and wherein, in a cross section of the honeycomb structure in a plane orthogonal to the first flow path, a number of the first partition walls on a radially inner side of the honeycomb structure is less than a number of the first partition walls on a radially outer side of the honeycomb structure.

* * * * *